US008382512B2

(12) United States Patent
Morita

(10) Patent No.: US 8,382,512 B2
(45) Date of Patent: Feb. 26, 2013

(54) FLAT CABLE CONNECTOR, HARNESS, AND METHOD FOR MANUFACTURING HARNESS

(75) Inventor: Makoto Morita, Miyoshi (JP)

(73) Assignee: J.S.T. Mfg. Co., Ltd., Osaka (JP)

( * ) Notice: Subject to any disclaimer, the term of this patent is extended or adjusted under 35 U.S.C. 154(b) by 0 days.

(21) Appl. No.: 12/954,192

(22) Filed: Nov. 24, 2010

(65) Prior Publication Data

US 2011/0130030 A1 Jun. 2, 2011

(30) Foreign Application Priority Data

Nov. 26, 2009 (JP) ..... 2009-268902
Oct. 13, 2010 (JP) ..... 2010-230835

(51) Int. Cl.
*H01R 12/24* (2006.01)

(52) U.S. Cl. ..... 439/499; 439/910

(58) Field of Classification Search ..... 439/492, 439/494, 495, 499, 910, 919, 269.2
See application file for complete search history.

(56) References Cited

U.S. PATENT DOCUMENTS 4,235,500 A * 11/1980 Belopavlovich et al. ..... 439/495
4,647,133 A * 3/1987 Renken et al. ..... 439/426
6,447,329 B1 * 9/2002 Yang ..... 439/492
6,514,100 B2 * 2/2003 Maegawa ..... 439/492

FOREIGN PATENT DOCUMENTS

JP 2002-203632 7/2002

* cited by examiner

*Primary Examiner* — Tulsidas C Patel
*Assistant Examiner* — Travis Chambers
(74) *Attorney, Agent, or Firm* — Jordan and Hamburg LLP

(57) ABSTRACT

A body housing supports a plurality of terminals, and an end of a flat cable that includes a conductor-exposed portion is disposed in the body housing. The cover housing is attached to the body housing, and holds the plurality of terminals and a plurality of conductors so as to be sandwiched between the body housing and the cover housing. The terminals are provided with a raised portion that is formed such that a portion of the terminals protrudes, and the plurality of terminals and the plurality of conductors in the conductor-exposed portion are respectively welded together by performing resistance welding with the terminals and the conductors abutting against each other via the raised portion. This enables welding to be performed with a small current with regard to resistance welding of the plurality of terminals of the flat cable connector and the plurality of conductors of the flat cable, thus reducing power consumption during welding, and can also achieve stable welding quality.

4 Claims, 25 Drawing Sheets

FLAT CABLE CONNECTOR, HARNESS, AND METHOD FOR MANUFACTURING HARNESS

CROSS-REFERENCE TO RELATED APPLICATIONS

This application claims priority to Japanese Patent Application Nos. 2009-268902 and 2010-230835. The entire disclosure of Japanese Patent Application Nos. 2009-268902 and 2010-230835 are hereby incorporated herein by reference.

BACKGROUND OF THE INVENTION

1. Field of the Invention

The present invention relates to a flat cable connector for connecting to a flat cable that is formed by insulating a plurality of conductors arranged parallel to each other, a harness (cable harness) including the a flat cable connector, and a method for manufacturing the harness.

2. Description of Related Art

Conventionally, flat cable connectors for connecting to a flat cable that is formed by insulating a plurality of conductors arranged parallel to each other are known (see JP 2002-203632A). The flat cable connector disclosed in JP 2002-203632A includes a connector housing (20) and a retainer (30) that engages with the connector housing. A conductor (wiring 12) at an end of a flat cable and a terminal (connection terminal 40) connected to the conductor are housed in the connector housing and the retainer. Further, the terminal is provided with a plate-like junction edge (42) that is welded to the conductor. The terminal and the conductor at the end of the flat cable are welded together by performing resistance welding in which a large current is conducted when two electrodes, namely, a positive electrode and a negative electrode, are brought into abutment against each other, with the plate face of the junction edge of the terminal placed in abutment on the conductor at the end of the flat cable. In this flat cable connector, a bonded portion (43) where the terminal and the conductor are welded together is housed in the connector housing and the retainer, with its periphery covered with a resin portion (44).

As described above, with the flat cable connector disclosed in JP 2002-203632A, the plate face of the plate-like junction edge of the terminal is placed in abutment on the conductor at the end of the flat cable when the terminal and the conductor at the end of the flat cable are welded together by resistance welding. Then, in that state, a large current is conducted from the two electrodes abutting against each other, thus performing resistance welding. For this reason, it is necessary to conduct a large current at the time of resistance welding the terminal and the conductor, leading to an increase in power consumption required for the resistance welding. Moreover, conduction of a large current causes variation in the welded state, and tends to lead to unstable welding quality.

SUMMARY OF THE INVENTION

In view of the foregoing circumstances, it is an object of the present invention to provide a flat cable connector that enables welding to be performed with a small current with regard to resistance welding of a plurality of terminals of the flat cable connector and a plurality of conductors of a flat cable, thus reducing power consumption during welding, and that can also achieve stable welding quality. It is another object of the invention to provide a harness (cable harness) including the flat cable connector, and a method for manufacturing the harness.

According to a first feature of a flat cable connector of the present invention for achieving the above-described objects, there is provided a flat cable connector for connecting to a flat cable that is formed by insulating a plurality of conductors arranged parallel to each other, the flat cable connector including: a plurality of terminals; a body housing that supports the plurality of terminals with the plurality of terminals disposed parallel to each other, and in which can be disposed an end of the flat cable that includes a conductor-exposed portion where the plurality of conductors are exposed by an insulation covering portion having been partly removed; and a cover housing that is engaged with and attached to the body housing and that holds the plurality of terminals and the plurality of conductors so as to be sandwiched between the body housing and the cover housing, with the plurality of terminals and the plurality of conductors in the conductor-exposed portion respectively abutting against each other, wherein the terminals and/or the conductors in the conductor-exposed portion are provided with a raised portion that is formed such that a portion of the terminals and/or the conductors in the conductor-exposed portion protrudes, and the plurality of terminals and the plurality of conductors in the conductor-exposed portion are respectively welded together by performing resistance welding with the terminals and the conductors abutting against each other via the raised portion.

With this configuration, the end of the flat cable that includes the conductor-exposed portion is disposed in the body housing that supports the plurality of terminals. Next, the cover housing is engaged with and attached to the body housing, and thereby the plurality of terminals and the plurality of conductors in the conductor-exposed portion are held between the cover housing and the body housing. Also, with the flat cable connector having this configuration, the plurality of terminals and the plurality of conductors are welded together by performing resistance welding with the terminals and the conductors abutting against each other via the raised portions 13*a* formed in the terminals and/or the conductors. Accordingly, with the use of the flat cable connector having this configuration, it is possible to weld the terminals and the conductors together by resistance welding in a state where a current is passed concentratedly to the raised portion that is formed such that a portion of the terminals protrudes. This makes it possible to significantly suppress the current required to be conducted for resistance welding to a small amount compared to the conventional technology, thus reducing the power consumption required for resistance welding. Furthermore, since the terminals and the conductors can be welded together in a state where a current is passed concentratedly to the raised portion, it is possible to suppress variation in the welded state, thus achieving stable welding quality.

Thus, with this configuration, it is possible to provide a flat cable connector that enables welding to be performed with a small current with regard to resistance welding of the plurality of terminals of the flat cable connector and the plurality of conductors of the flat cable, thus reducing power consumption during welding, and that can also achieve stable welding quality.

According to a second feature of the flat cable connector of the present invention, in the flat cable connector having the first feature, the raised portion is formed so as to protrude, in the terminals and/or the conductors in the conductor-exposed portion, by performing a pressing process or by performing a folding process for making a plurality of bends.

With this configuration, the raised portion is formed by a pressing process or by a folding process for making a plurality of bends, and therefore it is possible to easily process the raised portion that is provided such that a portion of the terminals protrudes, even in the case where the size of the terminals or the conductors is small.

According to a third feature of the flat cable connector of the present invention, in the flat cable connector having the second feature, the raised portion is formed in the terminals by performing a pressing process or by performing a folding process for forming a plurality of bends, so as to protrude across a width direction that is perpendicular to the longitudinal direction of the terminals.

With this configuration, the raised portion is formed so as to protrude in the width direction by performing a pressing process or a folding process for making a plurality of bends. Accordingly, even for a terminal having a short length in the width direction, it is possible to easily process a raised portion that is provided such that a portion of the terminal protrudes. Further, by processing the raised portion for the terminals, which have higher rigidity than the conductors of the flat cable, it is possible to easily ensure good shape stability in the processed raised portion. Accordingly, it is possible to easily ensure a state of contact between of the terminals and the conductors via only the raised portion during resistance welding.

According to a fourth feature of the flat cable connector of the present invention, in the flat cable connector having the first feature, in the end of the flat cable, the conductor-exposed portion is formed by uncovering an insulation covering portion so as to be pulled out in the direction of extension of the plurality of conductors, and a tip insulation covering portion is provided by a part of the covering portion that has been displaced so as to be pulled out being left at a tip of the end of the flat cable, the cover housing is provided with a conductor-facing portion that is formed so as to protrude in a block shape toward the plurality of conductors in the conductor-exposed portion and that is disposed such that a tip thereof faces the conductors, and the conductor-facing portion is disposed such that the tip thereof abuts against the conductors, or disposed such that the spacing between the tip thereof and the conductors is smaller than the spacing between the surface of the conductors and the surface of the tip insulation covering portion.

With this configuration, in the end of the flat cable, the tip insulation covering portion is provided at the tip end of the conductor-exposed portion at the time of forming the conductor-exposed portion. Accordingly, it is possible to prevent the plurality of conductors from unraveling at the end of the flat cable that is provided with the conductor-exposed portion. This facilitates the operation of connecting the flat cable connector to the flat cable, thus improving the operational efficiency. Furthermore, according to this configuration, the cover housing is provided with the conductor-facing portions protruding in a block shape and facing the plurality of conductors. Also, the conductor-facing portion is disposed such that its tip abuts against the conductors. Alternatively, the conductor-facing portion is disposed such that the spacing between its tip and the conductors is smaller than the spacing between the surface of the conductors and the surface of the tip insulation covering portion. Accordingly, even in the case where external force such as tension is exerted on the end of the flat cable that is disposed between the body housing and the cover housing, the conductor-facing portions come into locking engagement with the tip insulation covering portion. This inhibits the end of the flat cable from being detached from between the body housing and the cover housing, making it possible to stably hold the end of the flat cable between the body housing and the cover housing.

According to a fifth feature of the flat cable connector of the present invention, in the flat cable connector having the fourth feature, a plurality of the conductor-facing portions are provided protruding in correspondence with the plurality of conductors so as to respectively face the plurality of conductors.

With this configuration, a plurality of conductor-facing portions are provided protruding in correspondence with the conductors, and can come into locking engagement with the tip insulation covering portion in positions respectively corresponding to the plurality of conductors abutting against the plurality of terminals. Accordingly, it is possible to stably hold the end of the flat cable between the body housing and the cover housing so as to inhibit misalignment between the terminals and the conductors that abut against each other.

According to a sixth feature of the flat cable connector of the present invention, in the flat cable connector having the first feature, the body housing is provided with a body-side opening that is formed so as to extend in a connector width direction that is a width direction perpendicular to a conductor extension direction that is a direction parallel to the direction of extension of the plurality of conductors being held between the body housing and the cover housing, and that causes the plurality of terminals to be exposed to the outside across the connector width direction, the cover housing is provided with a cover-side opening that is formed so as to extend across the connector width direction, and that causes the plurality of conductors in the conductor-exposed portion to be exposed to the outside across the connector width direction, the body-side opening and the cover-side opening are provided so as to be open toward each other via the plurality of conductors and the plurality of terminals being held, and the plurality of terminals and the plurality of conductors in the conductor-exposed portion are respectively welded together by performing resistance welding via the body-side opening and the cover-side opening.

With this configuration, the body-side opening and the cover-side opening that cause the plurality of terminals and the plurality of conductors to be exposed to the outside across the connector width direction are formed in the body housing and the cover housing, respectively, so as to face each other via the plurality of terminals and the plurality of conductors. Also, the plurality of terminals and the plurality of conductors are welded together by performing resistance welding via the body-side opening and the cover-side opening. Accordingly, with the use of the flat cable connector of the present invention, it is possible to easily perform resistance welding by inserting the electrodes, respectively, from the body-side opening and the cover-side opening that are widely open across the connector width direction, into the plurality of terminals and the plurality of conductors that are held between the body housing and the cover housing, then causing the electrodes to abut against each other, and also conducting a current between the electrodes. It is also possible to significantly alleviate constraints on the electrodes that are to be inserted because the body-side opening and the cover-side opening are formed so as to be widely open across the connector width direction. Since constraints on the electrodes can be significantly alleviated in this way, it is possible to easily weld together the plurality of terminals and the plurality of conductors that are disposed abutting against each other via the raised portions by resistance welding using electrodes that are appropriately selected from among various electrodes having various configurations in consideration of the operability and the efficiency. This facilitates the operation of connecting the flat cable connector to the flat cable, which also makes it possible to reduce the processing time required from the completion of welding between all the terminals and all the conductors until the end of connection therebetween.

According to a seventh feature of the flat cable connector of the present invention, in the flat cable connector having the sixth feature, at least one of the body-side opening and the cover-side opening is formed so as to spread outwardly with an opening area thereof being enlarged.

With this configuration, at least one of the body-side opening and the cover-side opening from which an electrode is inserted at the time of resistance welding is formed so as to spread outwardly with its opening area being enlarged. Accordingly, it is possible to form an opening that can secure, in the vicinity of locations where the terminals and the conductors abut against each other and welded together via the raised portion, a space required for disposing the distal portion of the electrode for passing a current concentratedly to the welded locations, while efficiently securing, in locations located a distance away from the welded locations, a wide space for alleviating constraints on the shape of the basal end of the electrode.

According to an eighth feature of the flat cable connector of the present invention, in the flat cable connector having the fourth feature, the body housing is provided with a body-side opening that is formed so as to extend in a connector width direction that is a width direction perpendicular to a conductor extension direction that is a direction parallel to the direction of extension of the plurality of conductors being held between the body housing and the cover housing, and that causes the plurality of terminals to be exposed to the outside across the connector width direction, the cover housing is provided with a cover-side opening that is formed so as to extend across the connector width direction, and that causes the plurality of conductors in the conductor-exposed portion to the outside across the connector width direction, the body-side opening and the cover-side opening are provided so as to be open toward each other via the plurality of conductors and the plurality of terminals being held, the plurality of terminals and the plurality of conductors in the conductor-exposed portion are respectively welded together by performing resistance welding via the body-side opening and the cover-side opening, and the conductor-facing portion is provided protruding so as to face the plurality of conductors on opposite sides in the conductor extension direction relative to the cover-side opening.

With this configuration, the conductor-facing portions are provided protruding on opposite sides in the conductor extension direction relative to the cover-side opening so as to face the conductors in the conductor-exposed portion. Accordingly, the conductor-facing portions can come into locking engagement with the tip insulation covering portion, and can also come into locking engagement with an edge of the covering portion located opposite to the tip insulation covering portion via the conductor-exposed portion. This makes it possible to stably hold the end of the flat cable between the body housing and the cover housing so as to inhibit misalignment between the terminals and the conductors that abut against each another, on opposite sides in the conductor extension direction relative to the welded locations between the terminals and the conductors.

According to a ninth feature of the flat cable connector of the present invention, in the flat cable connector having the first feature, one of the body housing and the cover housing is provided with a plurality of inter-conductor projections that are disposed between the plurality of conductors and that are formed protruding so as to be inserted between the plurality of conductors.

With this configuration, one of the body housing and the cover housing is provided with the plurality of inter-conductor projections that are formed protruding so as to be inserted between the plurality of conductors. Accordingly, when the conductor-exposed portion at the end of the flat cable is disposed between the body housing and the cover housing, the conductors in the conductor-exposed portion can be guided to predetermined positions by the plurality of inter-conductor projections, making it possible to accurately position the conductors in locations where they abut against the terminals.

According to a tenth feature of the flat cable connector of the present invention, in the flat cable connector having the ninth feature, the plurality of inter-conductor projections are provided in the body housing.

With this configuration, provision of the inter-conductor projections in the body housing allows the conductors to be guided by the plurality of inter-conductor projections and accurately positioned in locations where they abut against the terminals when the end of the flat cable is disposed in the body housing. This makes it possible to accurately position the conductors and the terminals in a state before the cover housing is attached to the body housing, thus easily performing positioning between the conductors and the terminals.

According to an eleventh feature of the flat cable connector of the present invention, in the flat cable connector having the first feature, in the end of the flat cable, the conductor-exposed portion is formed by uncovering an insulation covering portion so as to be pulled out in the direction of extension of the plurality of conductors, and a tip insulation covering portion is provided by a part of the covering portion that has been displaced so as to be pulled out being left at a tip of the end of the flat cable, and the plurality of terminals are integrally molded with the body housing in a state where the terminals are bent in such a manner that a portion thereof facing the tip insulation covering portion when abutting against the conductor-exposed portion is spaced away from the tip insulation covering portion.

With this configuration, at the end of the flat cable, the tip insulation covering portion is provided at the tip end of the conductor-exposed portion at the time of forming the conductor-exposed portion. Accordingly, it is possible to prevent the plurality of conductors from unraveling in the end of the flat cable that is provided with the conductor-exposed portion. This facilitates the operation of connecting the flat cable connector to the flat cable, thus improving the operational efficiency. Also, the plurality of terminals are integrally formed with the body housing in a state where the terminals are bent in such a manner that the portion facing the tip insulation covering portion is spaced away from the tip insulation covering portion. Accordingly, even if the tip insulation covering portion is provided in the end of the flat cable, it is possible to prevent the plurality of terminals and the tip insulation covering portion from interfering with each other at the time of connection. This makes it possible to prevent displacement of positioning between the plurality of terminals and the plurality of conductors in the conductor-exposed portion due to interference between the plurality of terminals and the tip insulation covering portion.

According to a feature of a harness of the present invention for achieving the above-described objects, there is provided a harness including: the flat cable connector having the first feature; and the flat cable to which the flat cable connector is connected.

With this configuration, it is possible to realize a harness that can achieve the same effect as that achieved by the flat cable connector having the first feature. Thus, with this configuration, it is possible to provide a harness that enables welding to be performed with a small current with regard to resistance welding of the plurality of terminals of the flat cable connector and the plurality of conductors of the flat cable, thus reducing power consumption during welding, and that can also achieve stable welding quality.

According to a first feature of a harness manufacturing method of the present invention for achieving the above-described objects, there is provided a harness manufacturing method for manufacturing a harness by connecting a flat cable connector to a flat cable formed by insulating a plurality of conductors arranged parallel to each other, the method including: a flat cable placement step of disposing, in a body housing that supports the plurality of terminals with the plurality of terminals disposed parallel to each other, an end of the flat cable that includes a conductor-exposed portion where the plurality of conductors are exposed by an insulation covering portion having been partly removed; a cover housing attachment step of engaging with and attaching to the body housing, a cover housing that holds the plurality of terminals and the plurality of conductors so as to be sandwiched between the body housing and the cover housing, with the plurality of terminals and the plurality of conductors in the conductor-exposed portion respectively abutting against each other; and a resistance welding step of respectively welding together the plurality of terminals and the plurality of conductors in the conductor-exposed portion by performing resistance welding by using a terminal-side electrode disposed so as to come into contact with the terminals and a conductor-side electrode disposed so as to come into contact with the conductors in the conductor-exposed portion and passing a current to the terminal-side electrode and the conductor-side electrode with the terminals and the conductors being sandwiched therebetween, wherein the terminals and/or the conductors in the conductor-exposed portion are provided with a raised portion that is formed such that a portion of the terminals and/or the conductors in the conductor-exposed portion protrudes, and, in the resistance welding step, the plurality of terminals and the plurality of conductors in the conductor-exposed portion are respectively welded together by performing resistance welding with the terminals and the conductors abutting against each other via the raised portion.

With this configuration, it is possible to realize a harness manufacturing method that can achieve the same effect as that achieved with the flat cable connector having the first feature. Therefore, it is possible, with this configuration, to provide a harness manufacturing method that enables welding to be performed with a small current with regard to resistance welding of the plurality of terminals of the flat cable connector and the plurality of conductors of the flat cable, thus reducing power consumption during welding, and that can also achieve stable welding quality.

According to a second feature of the harness manufacturing method of the present invention, in the harness manufacturing method having the first feature, the raised portion is provided in either the terminals or the conductors, a first electrode that is one of the terminal-side electrode and the conductor-side electrode comes into contact with the terminals or the conductors that are provided with the raised portion, and a second electrode that is the other of the terminal-side electrode and the conductor-side electrode comes into contact with the terminals or the conductors that are not provided with the raised portion, the second electrode includes a portion that is formed in a shape whose cross-sectional area decreases distally, and a contact area in which the first electrode is in contact with the terminals or the conductors that are provided with the raised portion is larger than a contact area in which the second electrode is in contact with the terminals or the conductors that are not provided with the raised portion.

With this configuration, the first electrode comes into contact with the terminals or the conductors that are provided with the raised portion, and the second electrode comes into contact with the terminals or the conductors that are not provided with the raised portion. Since the second electrode is provided with a portion whose cross-sectional area decreases distally, it is possible to pass a current concentratedly to a narrow region. This makes it possible to efficiently bring the distal end of the second electrode into contact with the terminals or the conductors that are not provided with the raised portion, in a narrow region located on the opposite side (the back side) of the locations where the terminals or the conductors that are not provided with the raised portion abut against the raised portion. Also, it is possible to efficiently pass a current concentratedly to the portions where the terminals or the conductors that are not provided with the raised portion abut against the raised portion. Furthermore, the contact area of the first electrode in contact with the terminals or the conductors that are provided with the raised portion is set larger than the contact area of the second electrode in contact with the terminals or the conductors that are not provided with the raised portion. Accordingly, during resistance welding, the portions in the terminals or the conductors that are provided with the raised portion that surround the raised portion on the side opposite to the protruding direction of the raised portion is stably supported by the first electrode having a larger contact area.

According to a third feature of the harness manufacturing method of the present invention, in the harness manufacturing method having the second feature, the second electrode includes a portion that is formed in a shape whose cross-sectional area decreases distally such that an outer circumference thereof forms a part of a conic section, and whose distal end is formed as a flat surface.

With this configuration, the second electrode is provided with the portion whose cross-sectional area decreases in the shape of a cone, and whose distal end is formed as a flat surface. Accordingly, it is possible to realize an electrode shape that enables a current to be passed concentratedly to the narrow distal region with a good space efficiency, and that can easily ensure, in the distal portion, the necessary contact area for the terminals or the conductors that are not provided with the raised portion, in the region on the opposite side (the back side) to the locations where the terminals or the conductors that are not provided with the raised portion abut against the raised portion.

According to a fourth feature of the harness manufacturing method of the present invention, in the harness manufacturing method having the first feature, the body housing is provided with a body-side opening that is formed so as to extend in a connector width direction that is a width direction perpendicular to a conductor extension direction that is a direction parallel to the direction of extension of the plurality of conductors being held between the body housing and the cover housing, and that causes the plurality of terminals to be exposed to the outside across the connector width direction, the cover housing is provided with a cover-side opening that is formed so as to extend across the connector width direction, and that causes the plurality of conductors in the conductor-exposed portion to be exposed to the outside across the connector width direction, the body-side opening and the cover-side opening are provided so as to be open toward each other via the plurality of conductors and the plurality of terminals being held, the terminal-side electrode is integrally formed so as to be capable of simultaneously coming into contact with the plurality of terminals, the conductor-side electrode is integrally formed so as to be capable of simultaneously coming into contact with the plurality of conductors in the conductor-exposed portion, and, in the resistance welding step, resistance welding is performed by inserting the terminal-side electrode from the body-side opening, inserting the conductor-side electrode from the cover-side opening, and passing a current to the terminal-side electrode and the conductor-side electrode, with the plurality of terminals and the plurality of conductors being sandwiched between the terminal-side electrode and the conductor-side electrode.

With this configuration, the terminal-side electrode that is formed integrally so as to be capable of simultaneously coming into contact with the plurality of terminals is inserted from the body-side opening, and the conductor-side electrode that is integrally formed so as to be capable of simultaneously coming into contact with the plurality of conductors in the conductor-exposed portion is inserted from the cover-side opening. Also, resistance welding can be performed by simultaneously pressurizing the plurality of terminals and the plurality of conductors between the terminal-side electrode and the conductor-side electrode, and also simultaneously passing a current to the plurality of terminals and the plurality of conductors. This makes it possible to simultaneously weld the plurality of terminals and the plurality of conductors together with the same timing, thus facilitating the welding operation of the plurality of terminals and the plurality of conductors and increasing the efficiency of the welding operation.

It should be appreciated that the above and other objects, and features and advantages of the present invention will become apparent from the following description taken in conjunction with the accompanying drawings.

BRIEF DESCRIPTION OF THE DRAWINGS

FIG. 19(*b*) is a perspective view illustrating an electrode according to a modification.

DETAILED DESCRIPTION OF THE INVENTION

Hereinafter, an embodiment of the present invention will be described with reference to the accompanying drawings. It should be appreciated that the present invention can be widely applied to various uses, as a flat cable connector for connecting to a flat cable that is formed by insulating a plurality of conductors arranged parallel to each other, a harness including the flat cable connector, and a method for manufacturing the harness.

Figure 1:
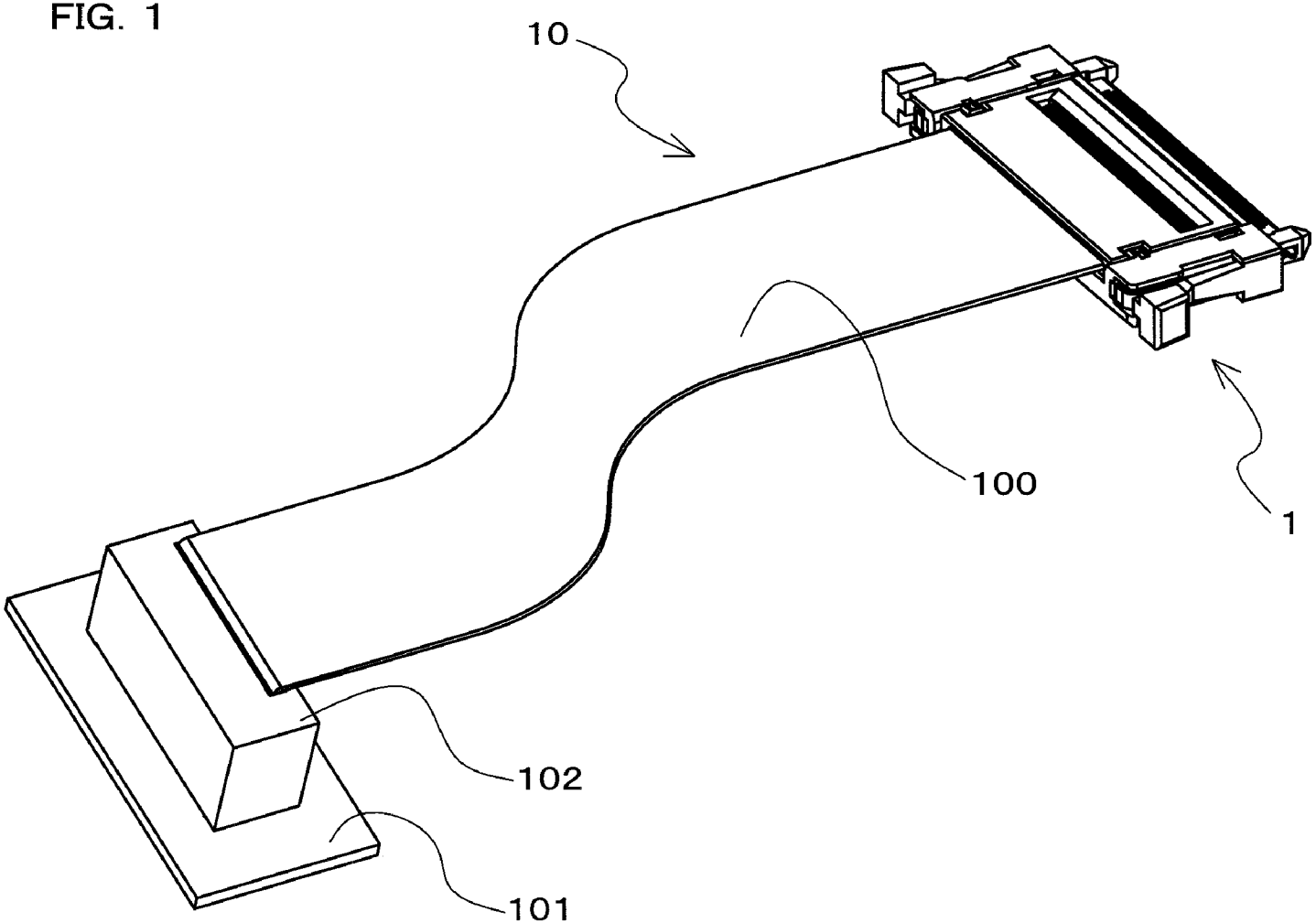
FIG. 1 is a perspective view illustrating a flat cable connector according to an embodiment of the present invention and a harness according to an embodiment of the invention, which is constructed using the flat cable connector.

FIG. 1 is a perspective view illustrating a flat cable connector 1 (hereinafter, may also be simply referred to as a "connector 1") according to an embodiment of the present invention and a harness (cable harness) 10 according to one embodiment that is constructed using the connector 1. The harness 10 illustrated in FIG. 1 includes the connector 1 according to this embodiment and a flat cable 100 to which the connector 1 is connected. For example, a printed board 101, only part of which is shown in FIG. 1, is connected to another printed board or device (not shown) via the harness 10. In the harness 10, the connector 1 is connected to one end of the flat cable 100, and the connector 1 can be connected to a mating connector (not shown) connected to another printed board or device. Further, a connector 102 for connecting to the printed board 101 can be connected to the other end of the flat cable 100.

Figure 2:
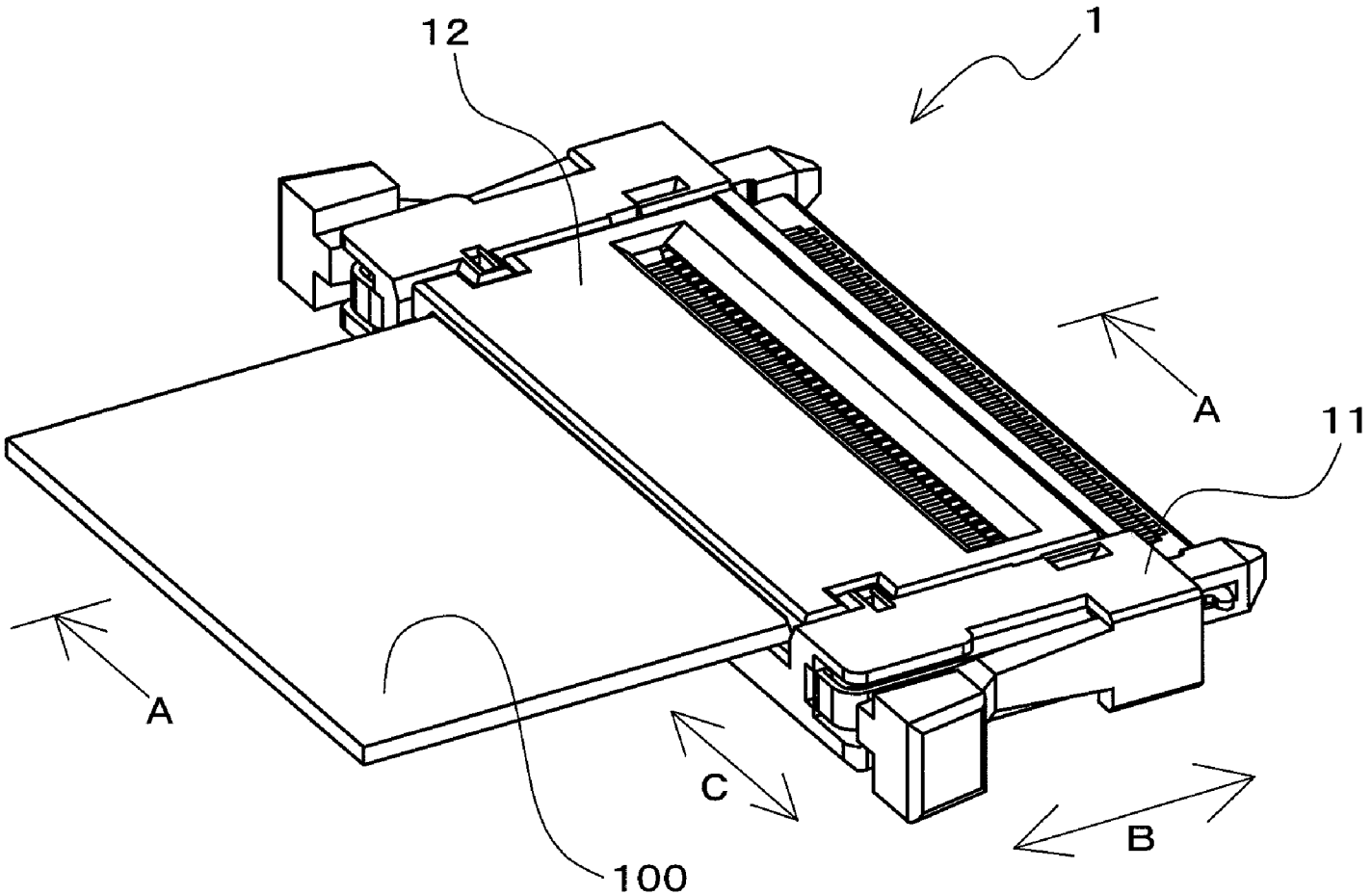
FIG. 2 is a perspective view illustrating the flat cable connector shown in FIG. 1 and a part of a flat cable.
Figure 3:
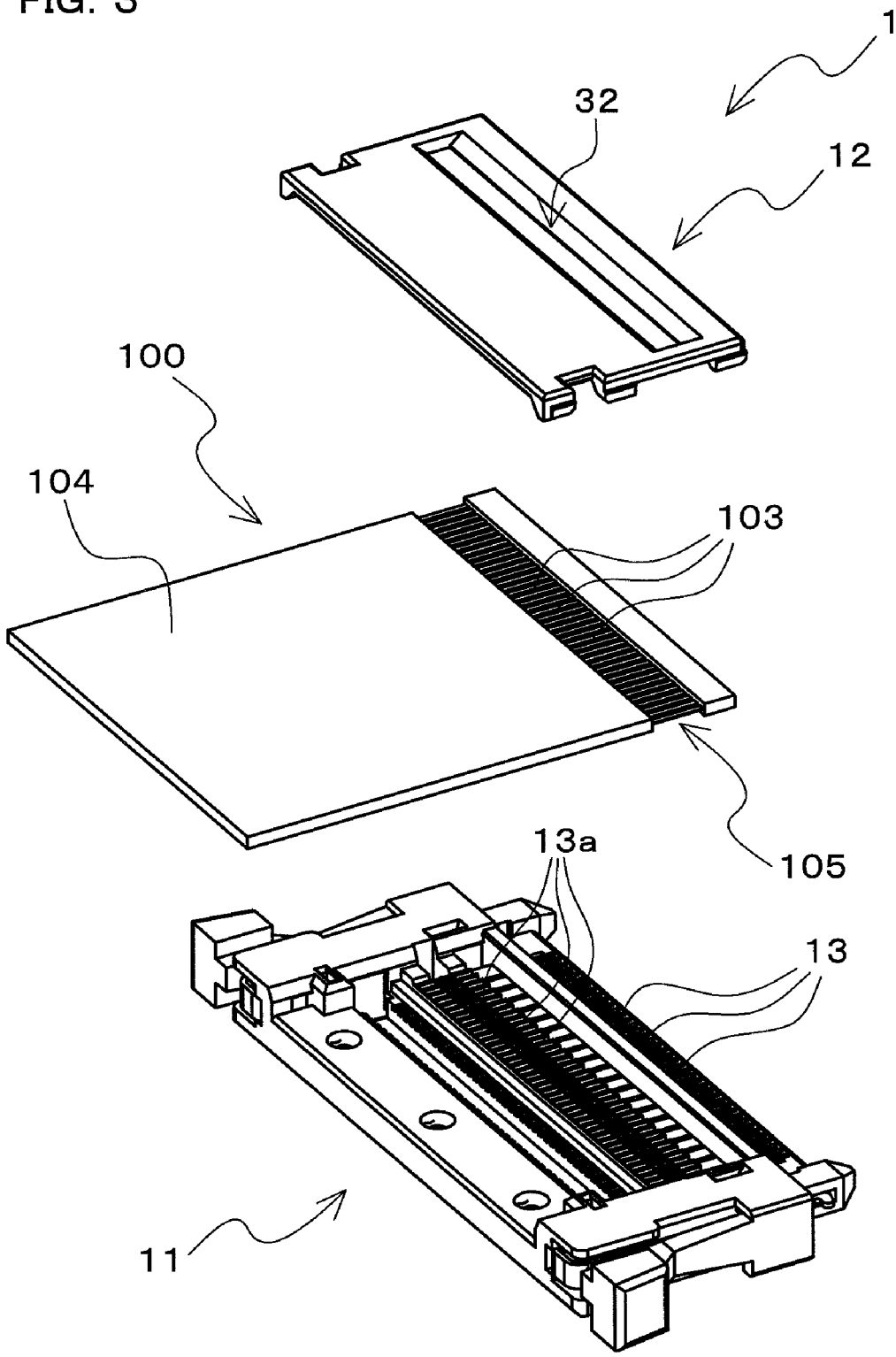
FIG. 3 is an exploded perspective view of FIG. 2.
Figure 4:
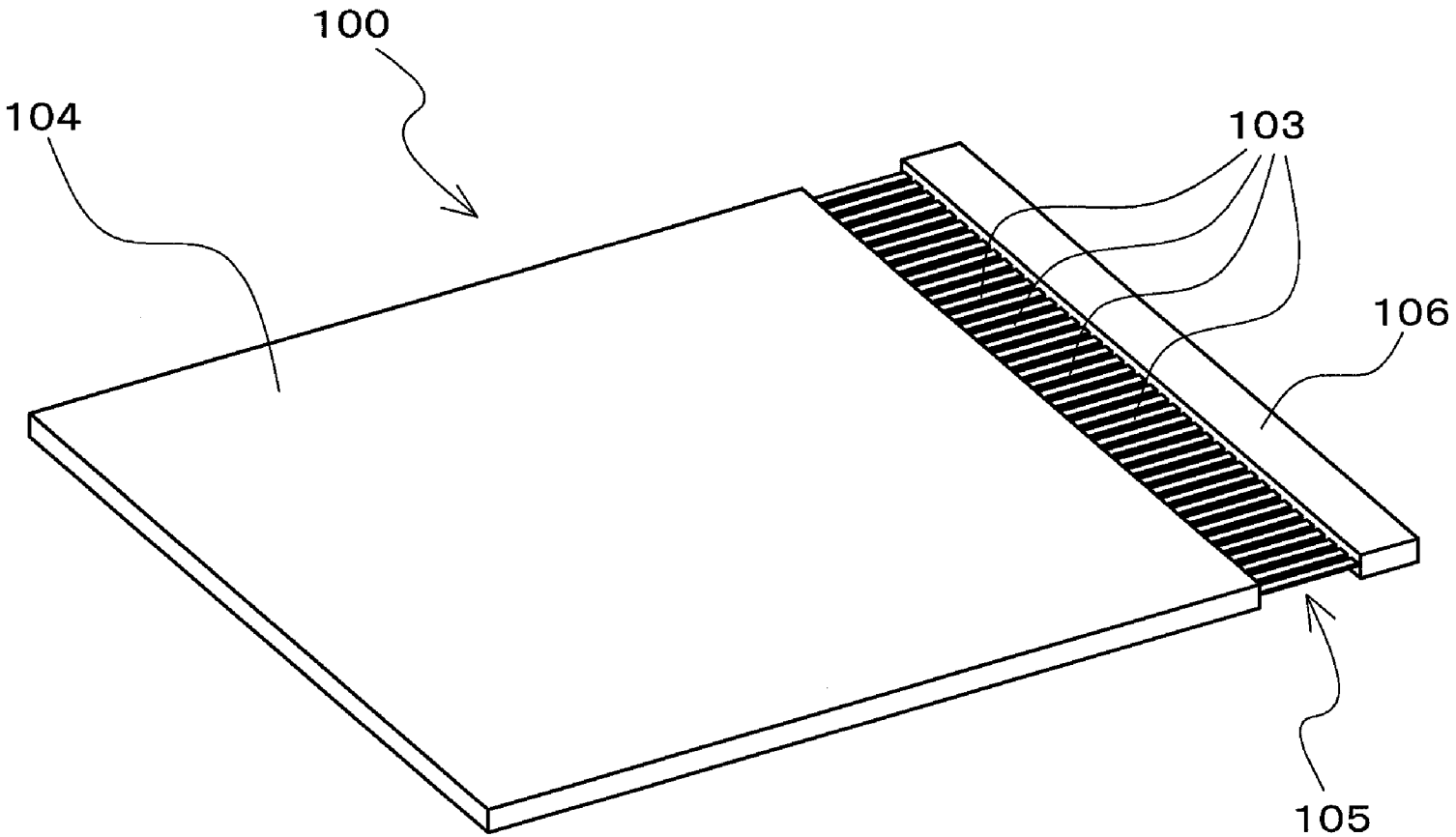
FIG. 4 is a perspective view illustrating the flat cable in FIG. 3 in enlargement.

FIG. 2 is a perspective view illustrating the connector 1 according to this embodiment and a part of the flat cable 100 to which the connector 1 is connected. FIG. 3 is an exploded perspective view of FIG. 2. FIG. 4 is a perspective view illustrating only the flat cable 100 in FIG. 3 in enlargement. The flat cable 100 shown in FIGS. 1 to 4 is constructed as a flexible flat cable (FFC), and is formed by insulating a plurality of conductors 103 arranged parallel to each other with a covering portion 104. For example, the flat cable 100 can be molded by extrusion-molding the plurality of conductors 103 and an insulation covering portion 104 into one piece. The conductors 103 are formed, for example, as an assembly of bundled fine wire rods. Note that this embodiment can be applied to not only flexible flat cables, but also flat cables other than flexible flat cables (for example, a flexible printed circuit board (FPC)).

As clearly shown in FIG. 4, a conductor-exposed portion 105 and a tip insulation covering portion 106 are provided at an end of the flat cable 100. The conductor-exposed portion 105 is provided as a portion where the plurality of conductors 103 are exposed by the insulation covering portion 104 having been partly removed. The conductor-exposed portion 105 is formed by uncovering the covering portion 104 such that the covering portion 104 is pulled out in the direction of extension of the plurality of conductors 103 (the direction in which the plurality of conductors 103 extend parallel to each other). The tip insulation covering portion 106 is formed by a part of the covering portion 104 that has been displaced so as to be pulled out being left at the tip, when the conductor-exposed portion 105 is formed in the above-described manner. Note that an opposite end of the flat cable 100 to the end at which the conductor-exposed portion 105 is provided is connected to the connector 102, as described above.

Next, the connector 1 of this embodiment will be described in detail. The connector 1 shown in FIG. 2 and FIG. 3 includes a body housing 11, a cover housing 12, and a plurality of terminals 13. The body housing 11 and the cover housing 12 are both made of a resin material having insulating properties. On the other hand, the plurality of terminals 13 are each made of a metallic material having high conductivity.

Figure 5:
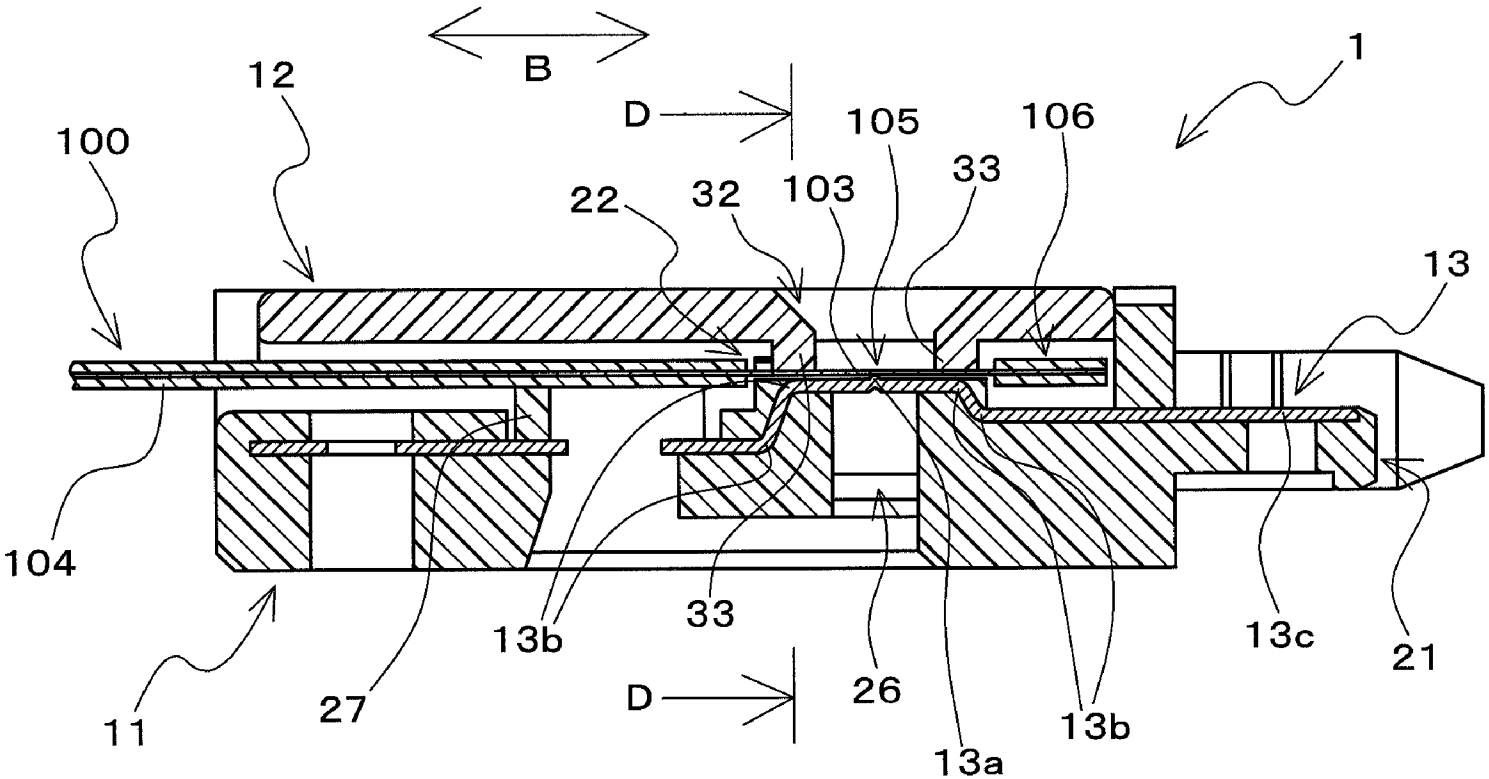
FIG. 5 is a cross-sectional view looking in the direction of the arrows A-A in FIG. 2.
Figure 6:
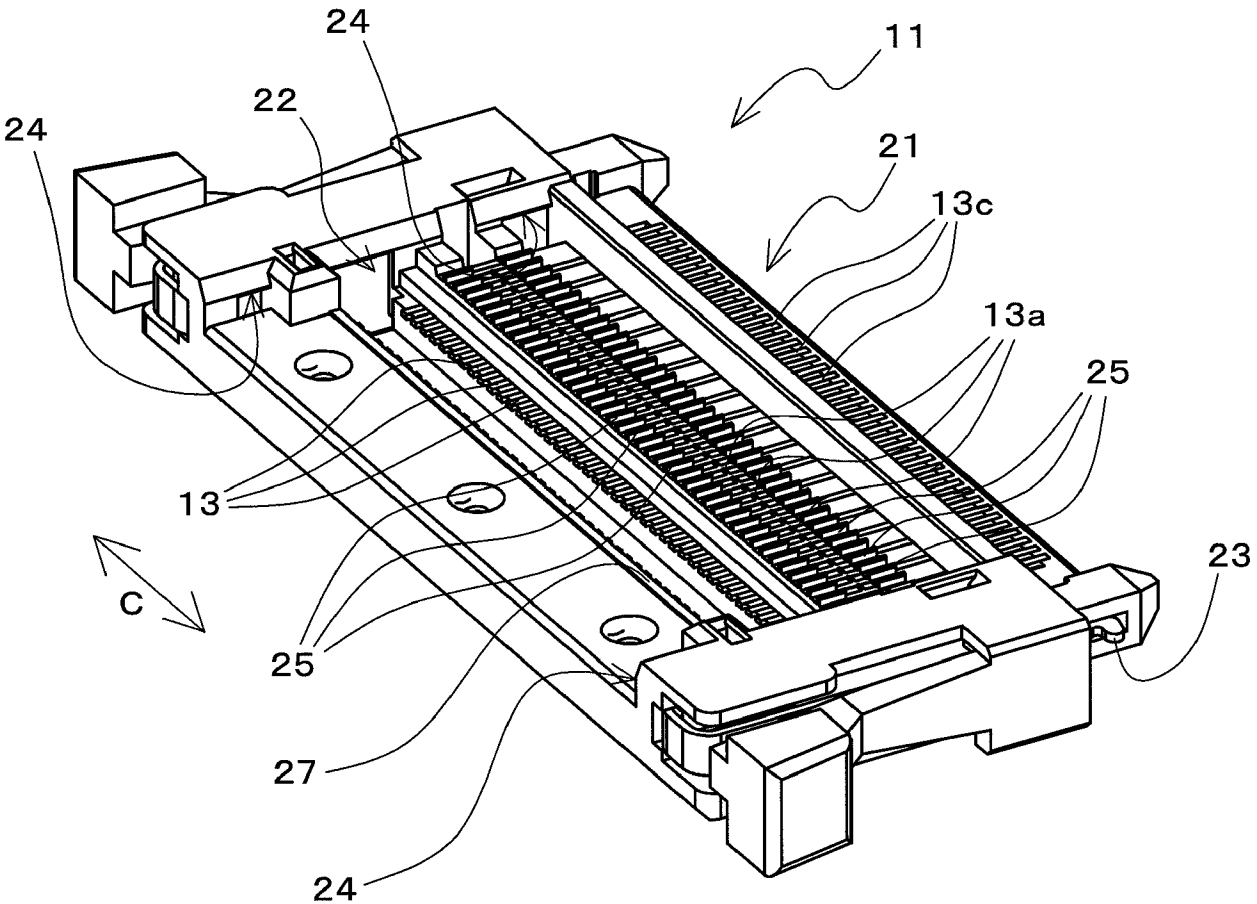
FIG. 6 is a perspective view illustrating a body housing of the flat cable connector shown in FIG. 3.
Figure 7:
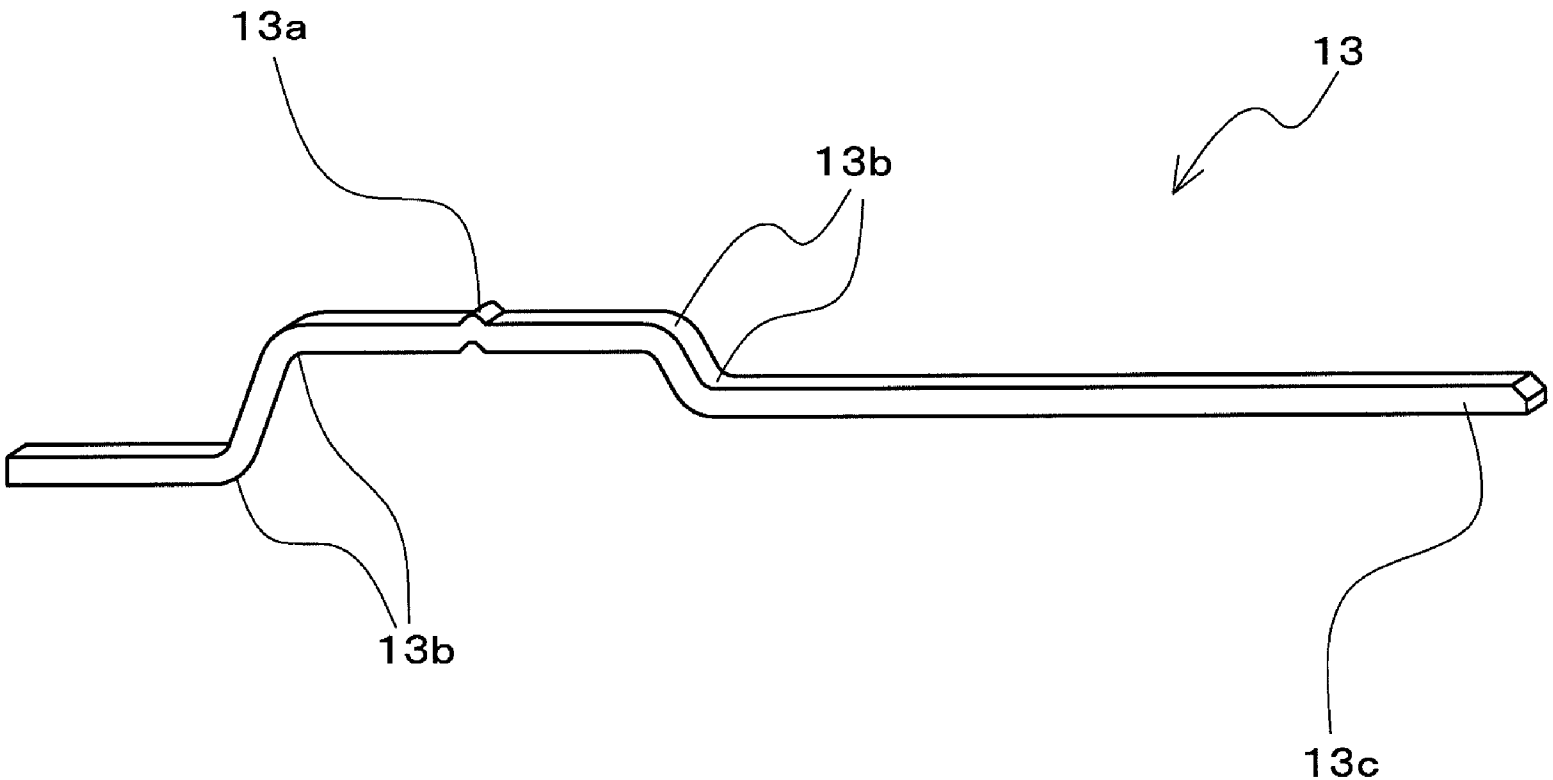
FIG. 7 is a perspective view illustrating a terminal of the flat cable connector shown in FIG. 5.

FIG. 5 is a cross-sectional view looking in the direction of the arrows A-A in FIG. 2, and FIG. 6 is a perspective view of the body housing 11 with which the plurality of terminals 13 are integrally molded. FIG. 7 is a perspective view illustrating only a single terminal 13. As shown in FIGS. 5 to 7, the plurality of terminals 13 are each formed in the shape of an elongated rod having a rectangular cross section, and provided as a metal piece having a portion that is bent in the middle. Also, the plurality of terminals 13 is molded integrally with and supported on the body housing 11 at the time of molding the body housing 11. Further, the plurality of terminals 13 are supported on the body housing 11 in a state where they are disposed such that their longitudinal directions extend parallel to each other. Note that FIG. 5 shows a cross-sectional view of the connector 1 at a position including a cross section in the longitudinal direction of the terminal 13.

Each of the terminals 13 is provided with a raised portion 13*a* serving as a location that is welded to each of the conductors 103 in the conductor-exposed portion 105 at the end of the flat cable 100 in a manner described below. The raised portion 13*a* is formed such that a portion of each of the terminals 13 protrudes toward the cover housing 12 that is attached to the body housing 11. Also, the raised portion 13*a* is formed such that a portion of each of the terminals 13 protrudes across a width direction that is perpendicular to the longitudinal direction of the terminal 13 by performing a pressing process or a folding process for making a plurality of bends. Accordingly, a portion of the terminal 13 that is located on the opposite side (the back side) of the raised portion 13*a* formed as a portion protruding toward the cover housing 12 is recessed.

Further, bent portions 13*b* that are bent is provided in each of the terminals 13, on its opposite longitudinal sides relative to the location where the raised portion 13*a* is provided. Note that a plurality of bent portions 13*b* (two bent portions 13*b* each in this embodiment) are provided on each of the opposite sides relative to the raised portion 13*a*. Consequently, in each of the terminals 13, a portion that is disposed between the bent portions 13*b* and in which the raised portion 13*a* is provided at substantially the center is formed as a portion raised on one side relative to the other portions. Further, one end 13*c* of each of the terminals 13 is disposed so as to be exposed outside the body housing 11 as a portion for being electrically connected to a mating terminal (not shown) of a mating connector (not shown) to which the connector 1 can be connected.

As shown in FIGS. 2, 3, 5, and 6, the body housing 11 is formed as a thin, substantially rectangular case that is open such that its central portion is widely recessed, and the body housing 11 is provided with a connection portion 21, a cable placement portion 22, engaging projections 23, engaging recesses 24, inter-conductor projections 25, a body-side opening 26, and so forth. The connection portion 21 is provided as one end of the body housing 11, and is formed as a portion that is fitted and connected to a mating connector (not shown) when the connector 1 is connected to that mating connector. As described above, in the connection portion 21, the end 13*c* of each of the plurality of terminals 13 is disposed in an exposed state, and is configured to be capable of coming into contact with the mating terminal of the mating connector. Further, the engaging projections 23 for engaging with the mating connector by being flexed so as to retract and then projecting by elastic deformation when the connector 1 is connected to the mating connector is provided on both lateral sides of the connection portion 21.

The cable placement portion 22 is formed as a central portion that is open to be widely recessed in the body housing 11, and is provided as a portion in which the end of the flat cable 100 that includes the conductor-exposed portion 105 is disposed. The flat cable 100 whose end is disposed in the cable placement portion 22 is disposed so as to be drawn out to the outside from the other end of the body housing 11 that is opposite to the connection portion 21 located on one side. Note that the cable placement portion 22 is provided with a cable supporting portion 27 that is formed protruding so as to be capable of abutting against the end of the flat cable 100 via the conductor-exposed portion 105 in the covering portion 104 located on the side opposite to the tip insulation covering portion 106, and that supports the end of the flat cable 100.

Figure 8:
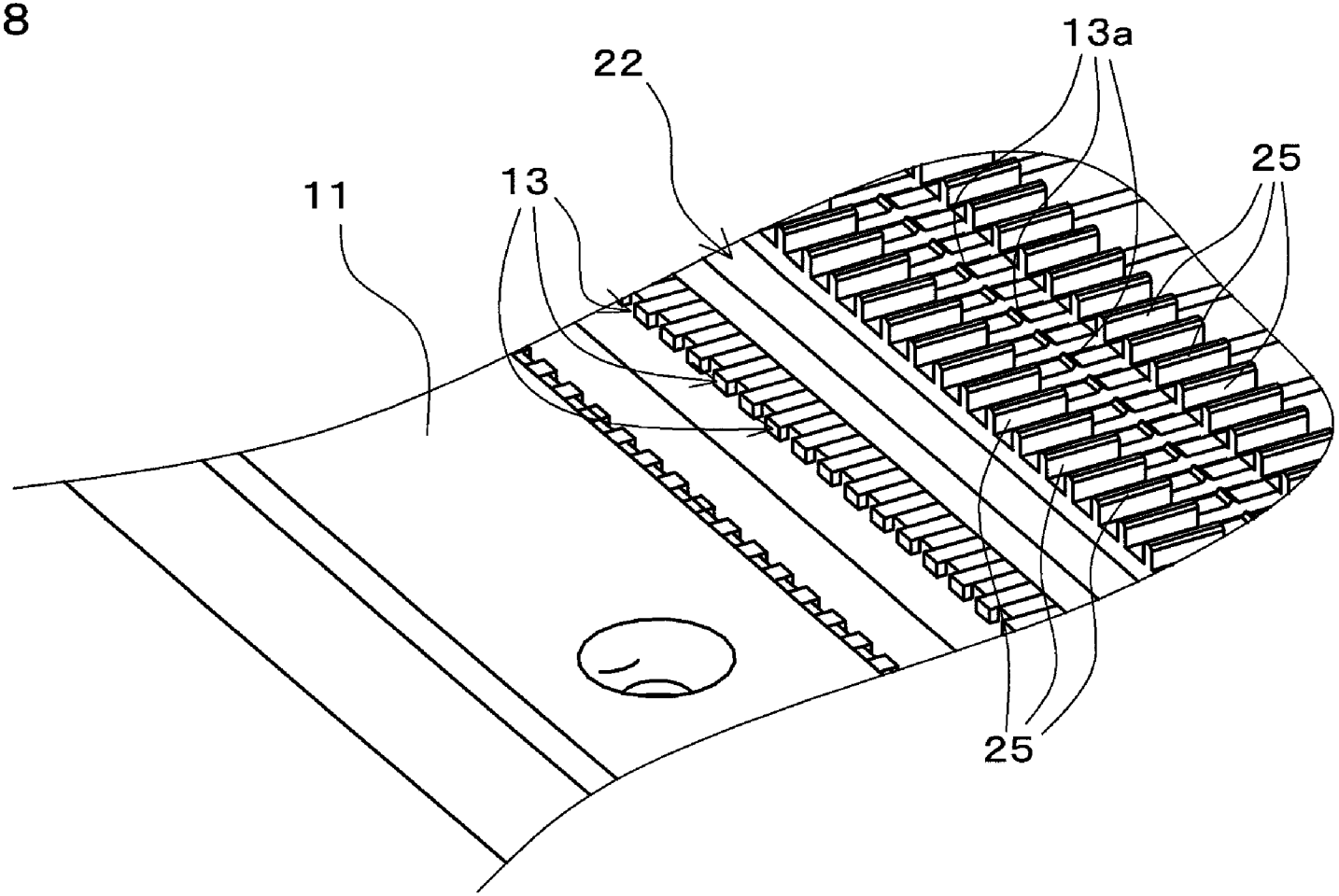
FIG. 8 is a partial enlarged view of FIG. 6.
Figure 9:
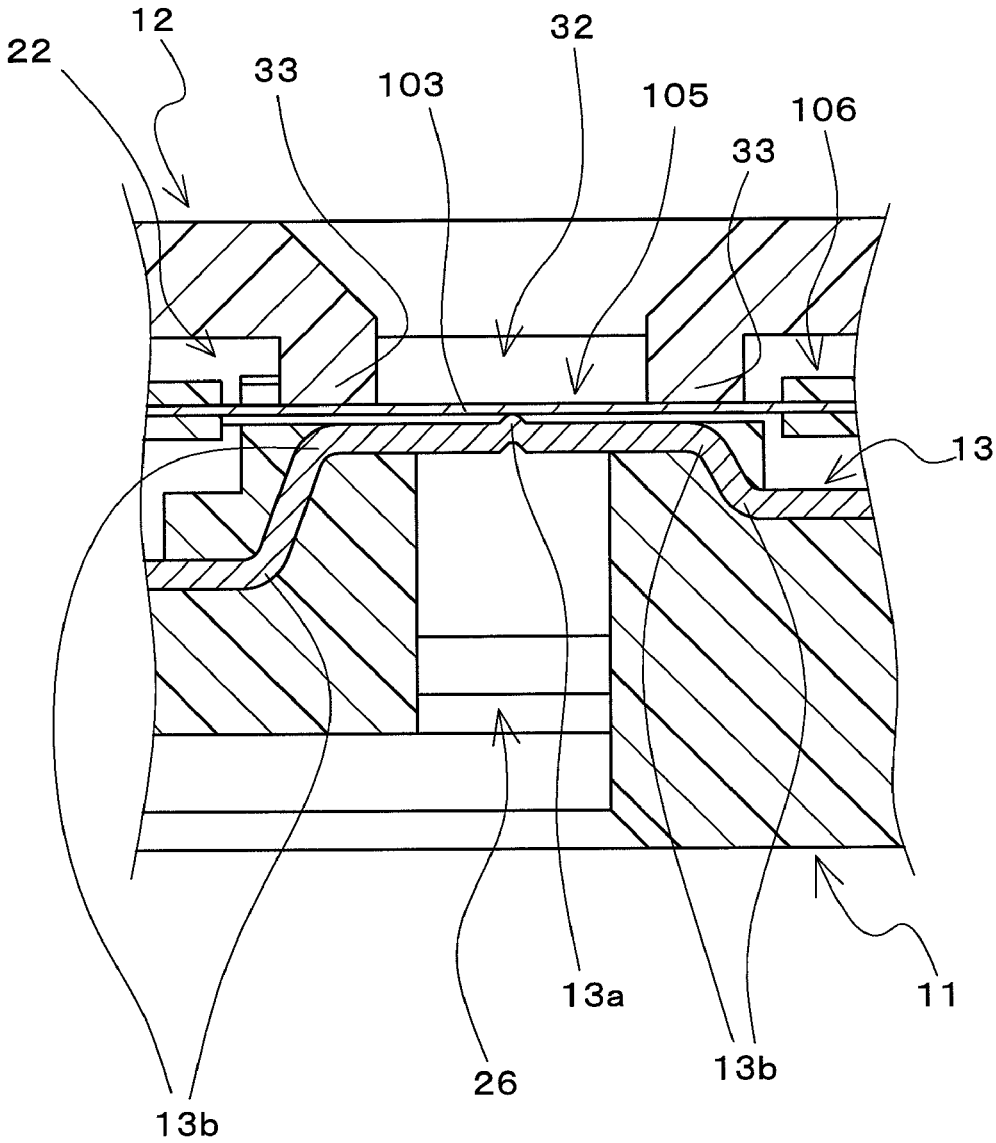
FIG. 9 is a partial enlarged view of FIG. 5.

FIG. 8 is a perspective view illustrating a part of FIG. 6 in enlargement. FIG. 9 is a cross-sectional view illustrating a part of FIG. 5 in enlargement. As shown in FIGS. 3, 5, 6, 8, and 9, in the cable placement portion 22, the raised portions 13*a* of the plurality of terminals 13 that are integrally molded with and supported on the body housing 11 are disposed so as to be exposed to the outside. The end of the flat cable 100 is disposed in the cable placement portion 22, with each of the conductors 103 in the conductor-exposed portion 105 abutting against each of the raised portions 13*a* of the plurality of terminals 13 and the end of the flat cable 100 extending straight (see FIGS. 5 and 9). Then, the cover housing 12 is attached to the body housing 11 with the end of the flat cable 100 being disposed in the cable placement portion 22, and thereby the plurality of terminals 13 and the plurality of conductors 103 are held so as to be sandwiched (see FIG. 5).

In the following description, as indicated by the double-ended arrows in FIGS. 2, 5, and 6, the direction of the connector 1 that is parallel to the direction of extension of the plurality of conductors 103 in a held state is taken as a conductor extension direction (the direction indicated by the double-ended arrow B), and the width direction of the connector 1, which is a direction perpendicular to the conductor extension direction, is taken as a connector width direction (the direction indicated by the double-ended arrow C).

The engaging recesses 24 are formed as portions recessed in inner walls disposed on opposites sides in the connector width direction relative to the cable placement portion 22, and are provided as portions engaging with the cover housing 12 when the cover housing 12 is attached to the body housing 11. A plurality of engaging recesses 24 (four engaging recesses 24 in this embodiment) are provided such that they are disposed on opposite sides in the connector width direction and are also disposed on opposite sides in the conductor extension direction in the body housing 11.

Figure 10:
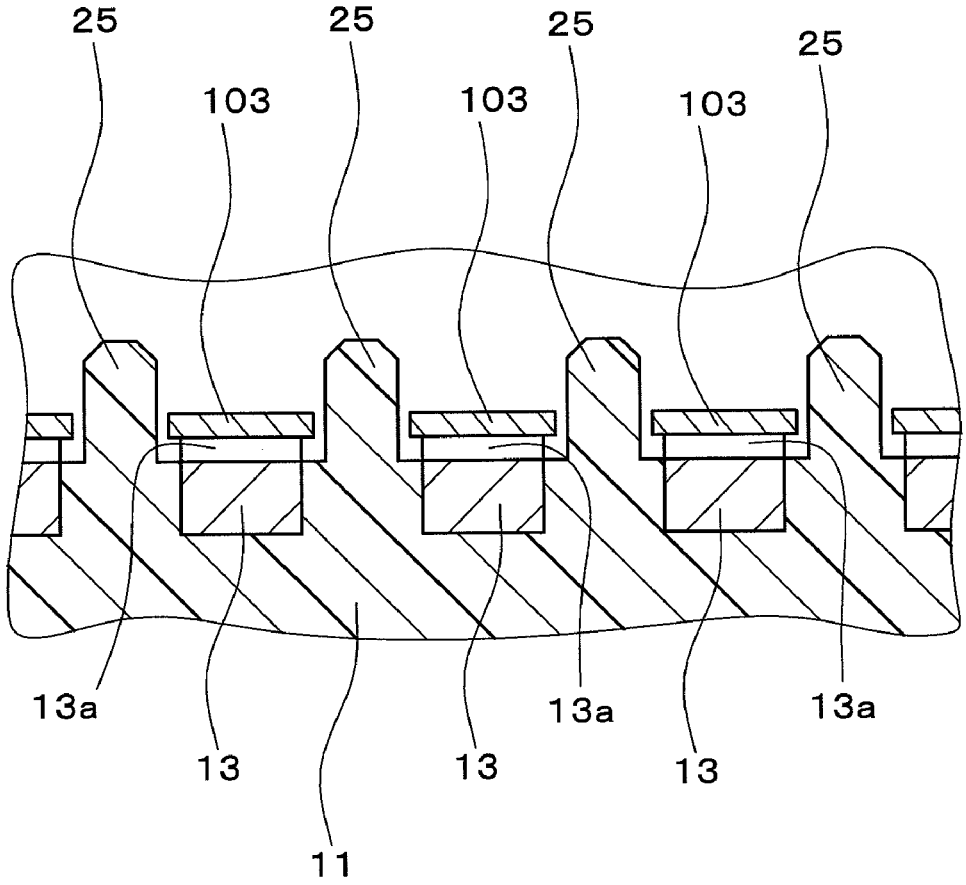
FIG. 10 is an enlarged cross-sectional view illustrating, in enlargement, a partial cross section of the body housing, the terminals, and the conductors, taken at a position corresponding to the position taken in the direction of the arrows D-D in FIG. 5 in a state where an end of the flat cable is disposed in the body housing.

FIG. 10 is an enlarged cross-sectional view illustrating, in enlargement, a partial cross section of the body housing 11, the terminals 13, and the conductors 103, taken at a position corresponding to the position taken in the direction of the arrows D-D in FIG. 5 in a state where an end of the flat cable 100 is disposed in the body housing 11. As shown in FIGS. 6, 8, and 10, a plurality of inter-conductor projections 25 are provided in the body housing 11. Also, the inter-conductor projections 25 are each formed so as to be disposed between the plurality of conductors 103 in the conductor-exposed portion 105 that are disposed so as to abut against the raised portions 13*a* of the plurality of terminal 13 in the cable placement portion 22, and are each provided protruding so as to be inserted between the plurality of conductors 103. Note that each of the inter-conductor projections 25 is formed as a rib extending parallel to the conductor 103. Further, the plurality of inter-conductor projections 25 are provided pairwise between the conductors 103, and are disposed between the respective conductors 103 on opposite sides in the conductor extension direction.

As clearly shown in FIGS. 5 and 9, the body-side opening 26 is formed so as to extend in the body housing 11 in the connector width direction, and is provided as an opening passing through the body housing 11 and being formed to have a rectangular cross section perpendicular to the thickness direction of the body housing 11 (the direction perpendicular to both the conductor extension direction and the connector width direction). Also, the body-side opening 26 is formed so as to cause the plurality of terminals 13 supported on the body housing 11 to be exposed to the outside across the connector width direction. Note that each of the terminals 13 is exposed to the outside at its portion facing the body-side opening 26 in a state where the raised portion 13*a* is disposed substantially at the center of the body-side opening 26 in the conductor extension direction. Further, the plurality of inter-conductor projections 25 that are provided pairwise between the conductors 103 disposed in the cable placement portion 22 are disposed one at each of positions sandwiching the body-side opening 26.

Note that in a state where the end of the flat cable 100 is disposed in the cable placement portion 22, the tip insulation covering portion 106 is disposed in the body housing 11 in a space that is provided between the connection portion 21 and the inter-conductor projection 25 located on the connection portion 21 side relative to the body-side opening 26 and that is partitioned by being recessed in a step shape, and therefore the tip insulation covering portion 106 is disposed so as not to interfere with the terminals 13. In this way, the plurality of terminals 13 are integrally molded with the body housing 11 in a state where each of the terminals 13 is bent in such a manner that its portion facing the tip insulation covering portion 106 at its tip end when the raised portion 13*a* abuts against the conductor-exposed portion 105 is spaced away from the tip insulation covering portion 106 in the body housing 11 (see FIG. 5).

Figure 11:
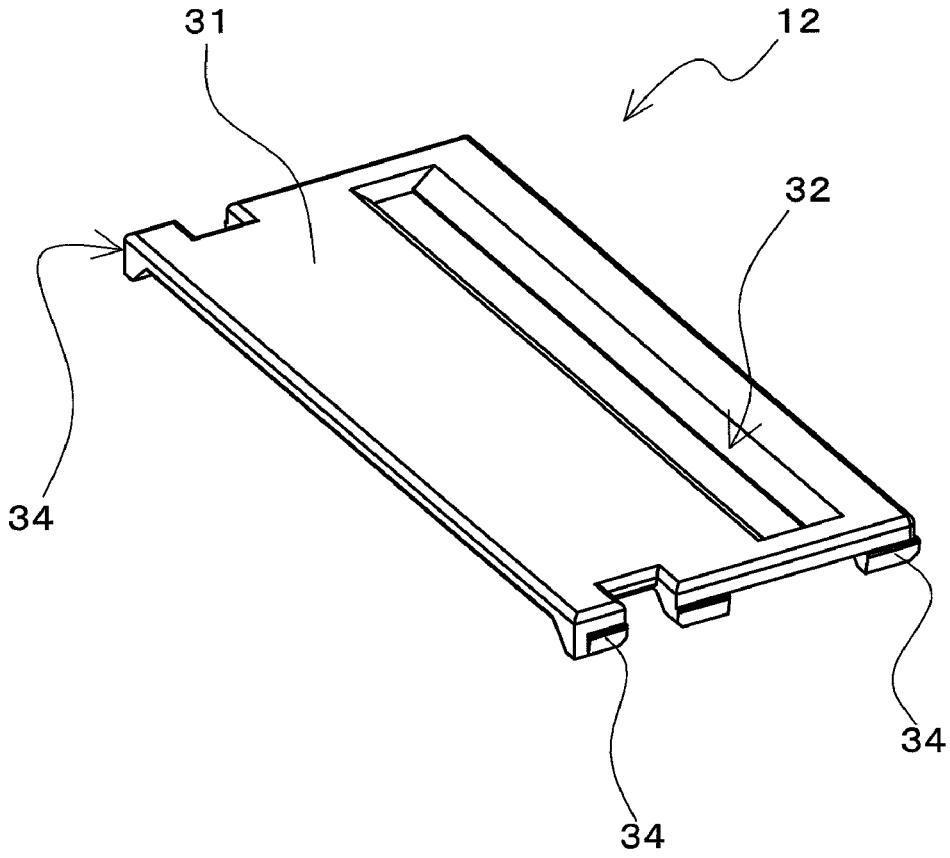
FIG. 11 is a perspective view illustrating the cover housing of the flat cable connector shown in FIG. 3.

FIG. 11 is a perspective view illustrating the cover housing 12. As shown in FIGS. 2, 3, 5, and 11, the cover housing 12 is formed separately from the body housing 11, and is provided as a substantially rectangular, lid-like member that is attached to the body housing 11. The cover housing 12 is attached to the body housing 11 in a state where the end of the flat cable 100 is disposed in the body housing 11 and each of the plurality of conductors 103 in the conductor-exposed portion 105 and each of the plurality of terminals 13 abut against one other via the raised portion 13*a*. Consequently, the cover housing 12 holds the plurality of conductors 103 and the plurality of terminals 13 so as to be sandwiched between the body housing 11 and the cover housing 12.

Figure 12:
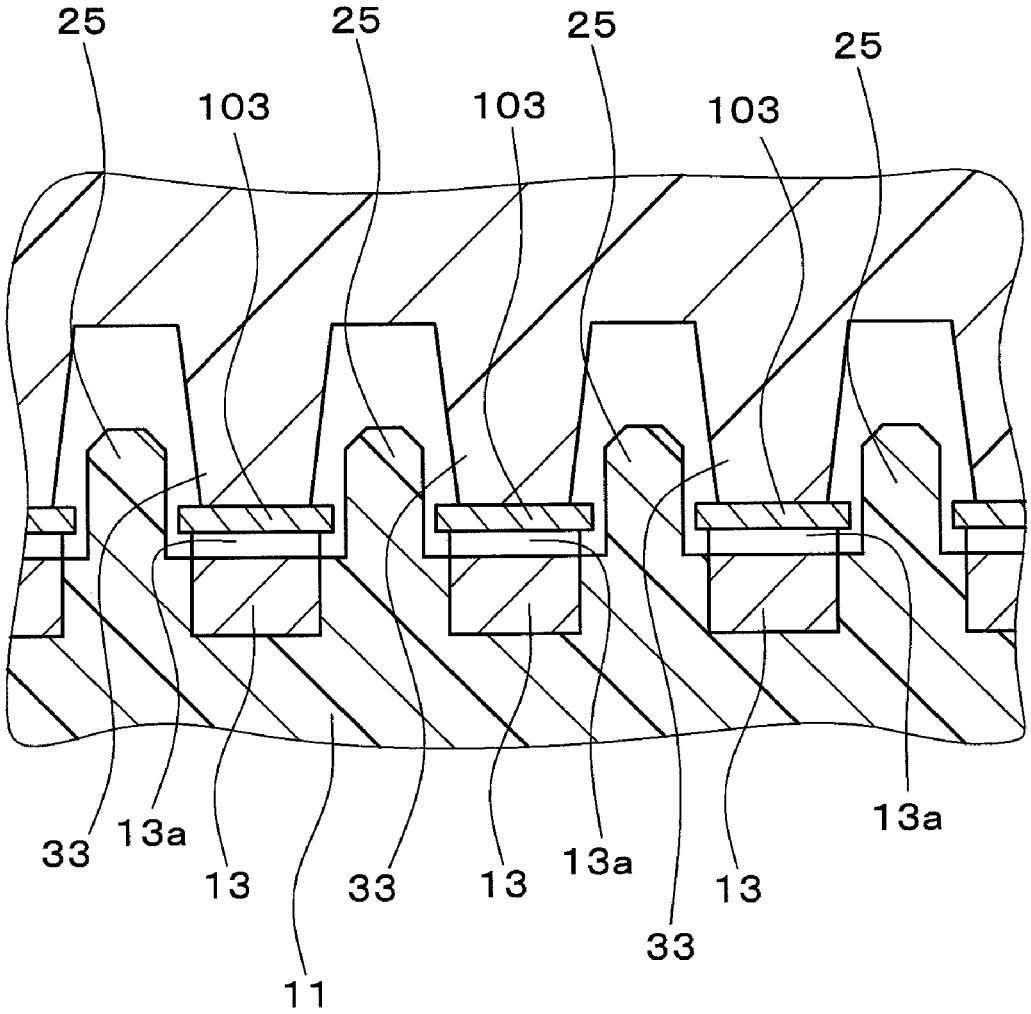
FIG. 12 is an enlarged cross-sectional view illustrating, in enlargement, a partial cross section of the cover housing, the body housing, the terminals, and the conductors at a position corresponding to the position taken in the direction of the arrows D-D in FIG. 5 in a state where the cover housing is attached to the body housing.

FIG. 12 is an enlarged cross-sectional view illustrating, in enlargement, a partial cross section of the cover housing 12, the body housing 11, the terminals 13, and the conductors 103 at a position corresponding to the position taken in the direction of the arrows D-D in FIG. 5 in a state where the cover housing 12 is attached to the body housing 11. As clearly shown in FIGS. 5, 9, 11, and 12, the cover housing 12 is provided with a lid portion 31, a cover-side opening 32, conductor-facing portions 33, engaging portions 34, and so forth. The lid portion 31 is formed as a plate-like portion that is disposed so as to cover the end of the flat cable 100 that is disposed in the body housing 11.

As clearly shown in FIGS. 2, 5, and 11, the cover-side opening 32 is formed so as to extend in the cover housing 12 in the connector width direction, and is provided as an opening passing through the cover housing 12 and being formed to have a rectangular cross section perpendicular to the thickness direction of the cover housing 12 (the direction perpendicular to both the conductor extension direction and the connector width direction). Further, the cover-side opening 32 is formed so as to spread outwardly with its opening area being enlarged (i.e., with the area of the above-described rectangular shape being enlarged). Also, the cover-side opening 32 is formed so as to cause the plurality of conductors 103 in the conductor-exposed portion 105 that are disposed so as to abut against the raised portions 13*a* of the plurality of terminals 13 to be exposed to the outside across the connector width direction. Further, the cover-side opening 32 and the body-side opening 26 are provided so as to be open toward each other via the plurality of conductors 103 and the plurality of terminals 13 being held by the cover housing 12 and the body housing 11. When the connector 1 is connected to the flat cable 100, the plurality of terminals 13 and the plurality of conductors 103 in the conductor-exposed portion 105 are respectively welded together by performing resistance welding via the cover-side opening 32 and the body-side opening 26 in a manner described below. Note that the plurality of terminals 13 and the plurality of conductors 103 are respectively welded together by performing resistance welding with the terminals 13 and the conductors 103 abutting against each other via the raised portions 13*a*.

As shown in FIGS. 5, 9, and 12, a plurality of conductor-facing portions 33 are provided in the cover housing 12. The conductor-facing portions 33 are formed so as to protrude in a block shape toward the plurality of conductors 103 in the conductor-exposed portion 105 that are disposed so as to abut against the raised portions 13*a* of the plurality of terminals 13 in the cable placement portion 22. Further, the plurality of conductor-facing portions 33 are provided protruding in correspondence with the plurality of conductors 103, and are disposed such that the tip of each of the conductor-facing portions 33 faces each of the plurality of conductors 103. Also, each of the conductor-facing portions 33 is disposed such that its tip abuts against each of the conductors 103.

Further, plurality of conductor-facing portions 33 are provided pairwise for each of the conductors 103, and are provided protruding so as to face the plurality of conductors 103 on opposite sides in the conductor extension direction relative to the cover-side opening 32. Note that in a state where the plurality of conductor-facing portions 33 face the plurality of conductors 103, the plurality of conductor-facing portions 33 and the plurality of inter-conductor projections 25 that protrude in opposite directions in the shape of comb teeth are disposed so as to protrude alternately in opposite directions in a sate in which each of the conductor-facing portions 33 and each of the inter-conductor projections 25 are adjacent to one other (see FIG. 12).

Figure 13:
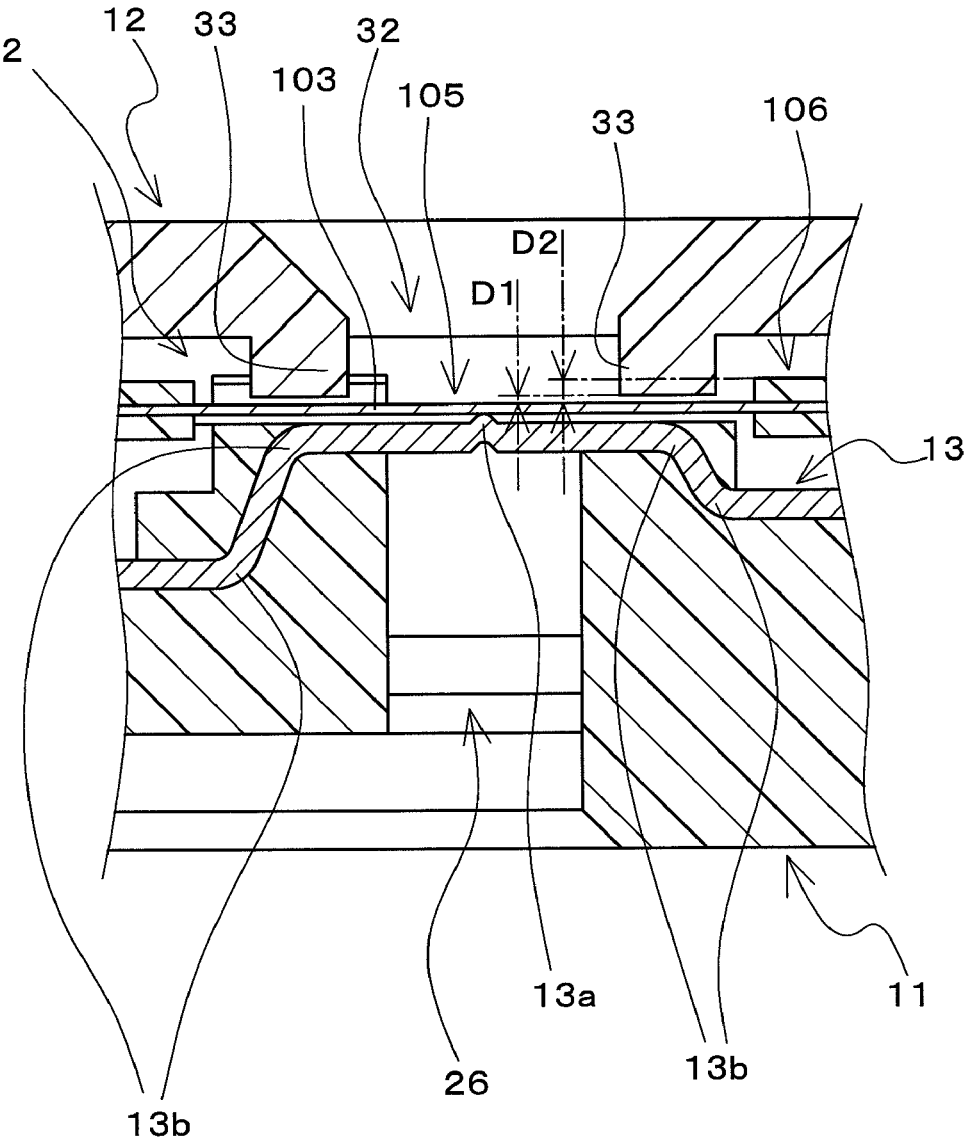
FIG. 13 is an enlarged cross-sectional view illustrating a modification of the arrangement of conductor-facing portions of the cover housing of the flat cable connector shown in FIG. 9.

Although a case where the tip of each of the conductor-facing portions 33 abuts against each of the conductors 103 has been described as an example in relation to FIGS. 5, 9, and 12, the tip of each of the conductor-facing portions 33 may face each of the conductors 103 via a gap. FIG. 13 is a cross-sectional view illustrating, in enlargement, a part of the connector 1 when each of the conductor-facing portions 33 is disposed facing each of the conductors 103 via a gap, showing an enlarged cross-sectional view taken at the cross section corresponding to FIG. 9. As shown in FIG. 13, each of the conductor-facing portions 33 may be disposed such a spacing D1 between its tip and each of the conductors 103 (the spacing indicated by the short dashed arrow D1 in FIG. 13) is smaller than a spacing D2 between the surface of the conductor 103 and the surface of the tip insulation covering portion 106 (the spacing indicated by the short dashed arrow D2 in FIG. 13).

As clearly shown in FIG. 11, the engaging portions 34 are provided in side wall portions protruding as side walls that are partially formed on opposite sides in the connector width direction relative to the lid portion 31 and coming into slidable contact with the inner wall of the body housing 11, and the engaging portions 34 are formed as portions protruding in a convex shape laterally outwardly relative to the side wall portions. Also, the engaging portions 34 are provided as portions engaging with the engaging recesses 24 of the body housing 11 when the cover housing 12 is attached to the body housing 11. At the time of attaching the cover housing 12 to the body housing 11, the engaging portions 34 protrude toward and engage with the engaging recesses 24 by the above-described side wall portions elastically recovering their original shapes after being flexed so as to retract to the inside.

A plurality of engaging portions 34 (four engaging portions 34 in this embodiment) are provided such that they are disposed on opposite sides in the connector width direction and are also disposed on opposite sides in the conductor extension direction relative to the conductor-facing portion 33 in the body housing 11. In this embodiment, the engaging portions 34 are disposed in the vicinity of four corners of the cover housing 12 respectively. The four engaging portions 34 engage with the four engaging recess 24 of the body housing 11, and thereby the cover housing 12 is attached to the body housing 11.

Next, a harness manufacturing method (hereinafter, may be simply referred to as a "manufacturing method of this embodiment") according to an embodiment of the present invention will be described. The manufacturing method of this embodiment is constructed as a harness manufacturing method in which the harness 10 is manufactured by connecting the connector 1 to the flat cable 100. To manufacture the harness 10 by the manufacturing method of this embodiment, first, the connector 1 and the flat cable 100 described above are provided. Then, processing steps of connecting the connector 1 to the end of the flat cable 100 are performed to implement the manufacturing method of this embodiment.

Figure 14:
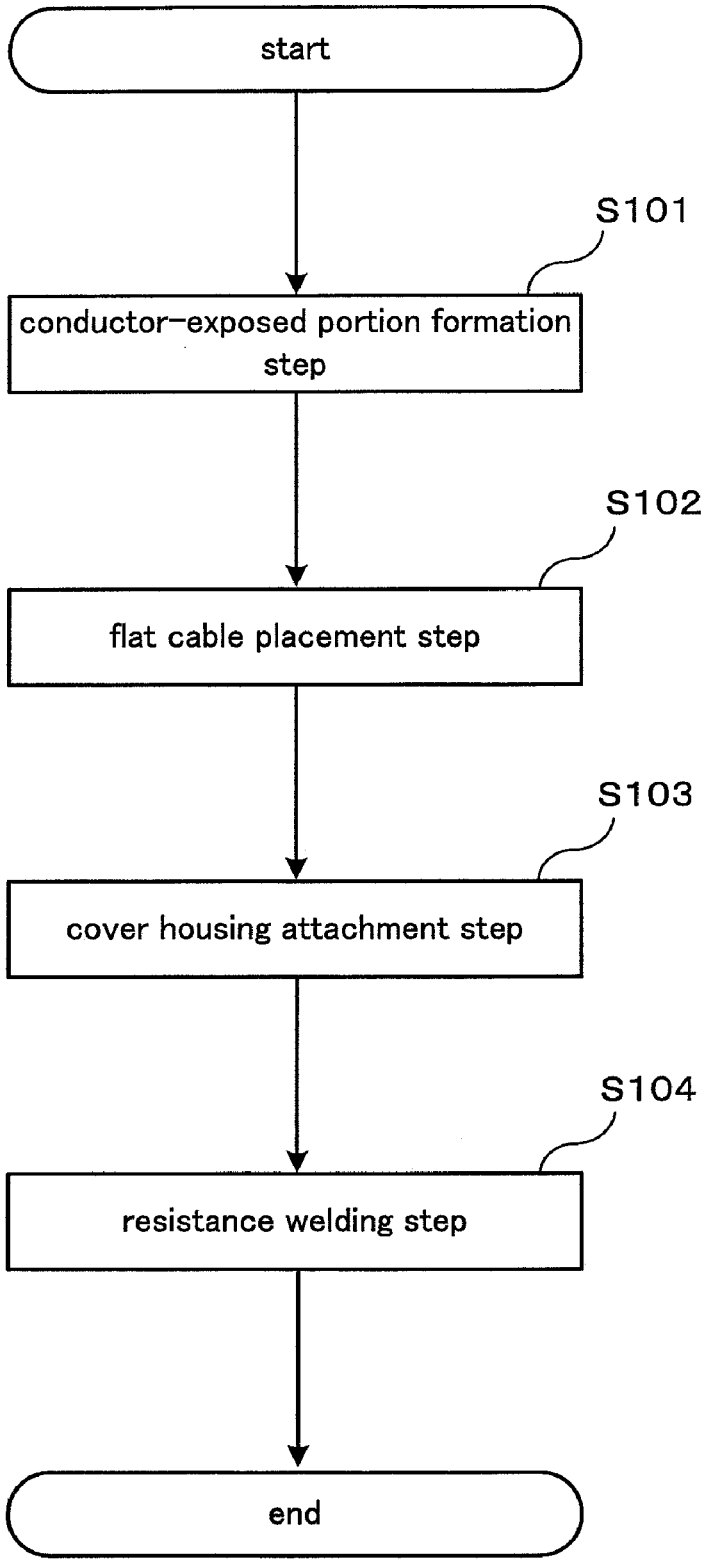
FIG. 14 is a flowchart illustrating a harness manufacturing method according to one embodiment of the present invention.

FIG. 14 is a flowchart illustrating the manufacturing method of this embodiment. As shown in FIG. 14, the manufacturing method of this embodiment includes a conductor-exposed portion formation step S101, a flat cable placement step S102, a cover housing attachment step S103, and a resistance welding step S104. By carrying out these steps (S101 to S104) in order, the processing steps of manufacturing the harness 10 by connecting the connector 1 to the flat cable 100 is performed.

In the conductor-exposed portion formation step S101, a process of forming a conductor-exposed portion 105 in a flat cable 100 that does not have a conductor-exposed portion 105 formed in its end is carried out. That is, the conductor-exposed portion 105 is formed by uncovering the covering portion 104 such that the covering portion 104 is pulled out in the direction of extension of the plurality of conductors 103 at the end of the flat cable 100 (see FIG. 4). The tip insulation covering portion 106 is also formed by a part of the covering portion 104 that has been displaced so as to be pulled out being left at the tip.

In the flat cable placement step S102, a process of disposing the end of the flat cable 100 that includes the conductor-exposed portion in the cable placement portion 22 of the body housing 11 is carried out. At this time, the end of the flat cable 100 is disposed in the body housing 11 such that each of the conductors 103 in the conductor-exposed portion 105 abuts against the raised portion 13*a* of each of the terminals 13 and that each of the inter-conductor projection 25 is inserted between the conductors 103 (see FIGS. 5 and 10).

The cover housing attachment step S103 is carried out in a state where each of the plurality of terminals 13 and each of the plurality of conductors 103 in the conductor-exposed portion 105 abut against each another via the raised portion 13*a* as described above. In the cover housing attachment step S103, a process of attaching the cover housing 12 to the body housing 11 by engagement of the engaging portions 34 with the engaging recesses 24. By carrying out the cover housing attachment step S103, each of the conductor-facing portions 33 is disposed facing each of the conductors 103, and the plurality of conductors 103 and the plurality of terminals 13 are held so as to be sandwiched between the cover housing 12 and the body housing 11.

Figure 15:
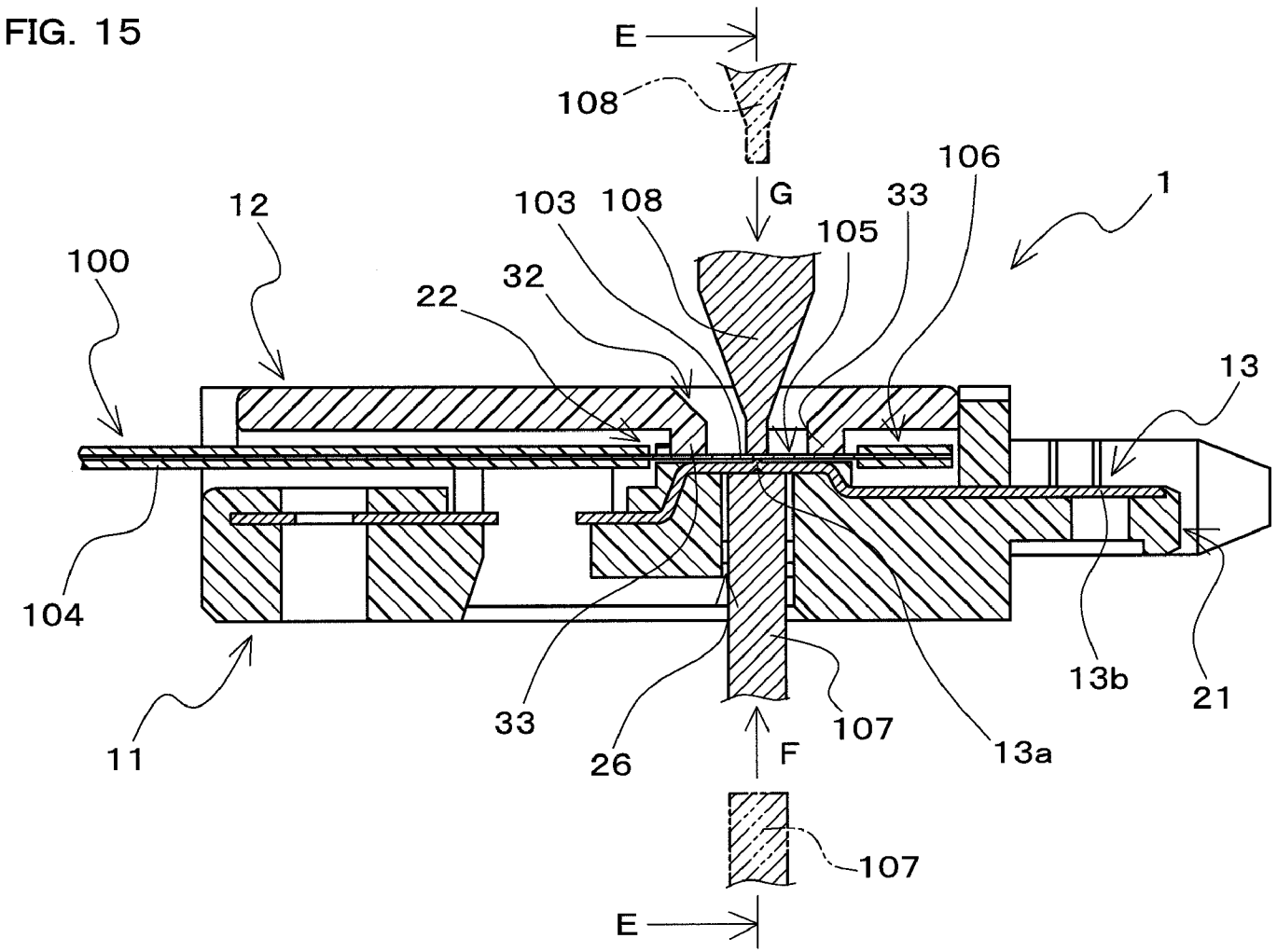
FIG. 15 is a cross-sectional view schematically illustrating how resistance welding is performed in a resistance welding step in the harness manufacturing method shown in FIG. 14.
Figure 16:
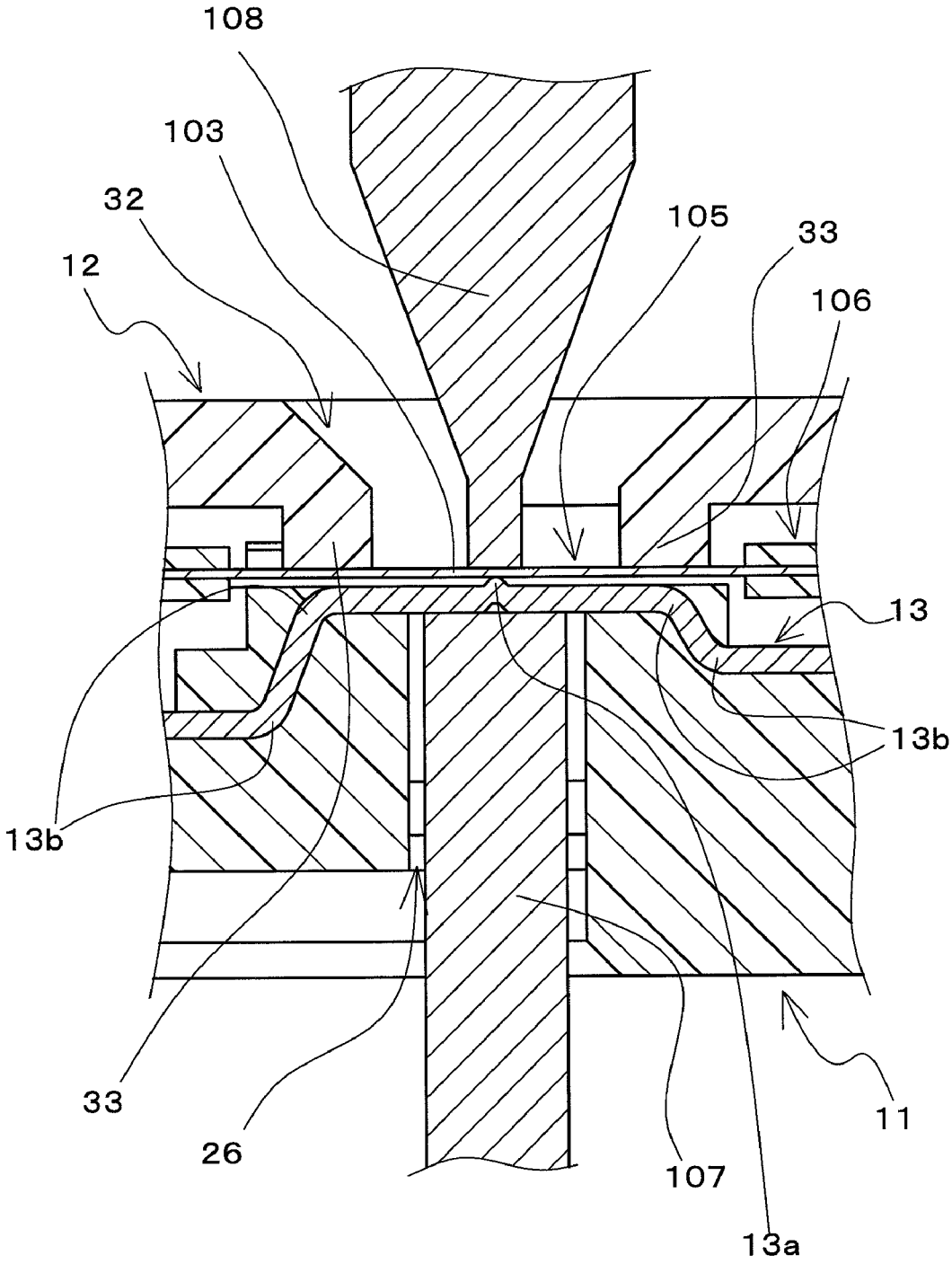
FIG. 16 is a partial enlarged view of FIG. 15.

In the resistance welding step S104, a process of welding each of the plurality of terminals 13 and each of the plurality of conductors 103 in the conductor-exposed portion 105 together by performing resistance welding via the body-side opening 26 and the cover-side opening 32 is carried out. FIG. 15 is a cross-sectional view schematically illustrating how resistance welding of the plurality of terminals 13 and the plurality of conductors 103 are performed in the connector 1 and the flat cable 100 in a state where the cover housing attachment step S103 is finished, showing a cross-sectional view corresponding to the sectional position in FIG. 5. FIG. 16 is an enlarged cross-sectional view illustrating a part of FIG. 15 in enlargement.

Figure 17:
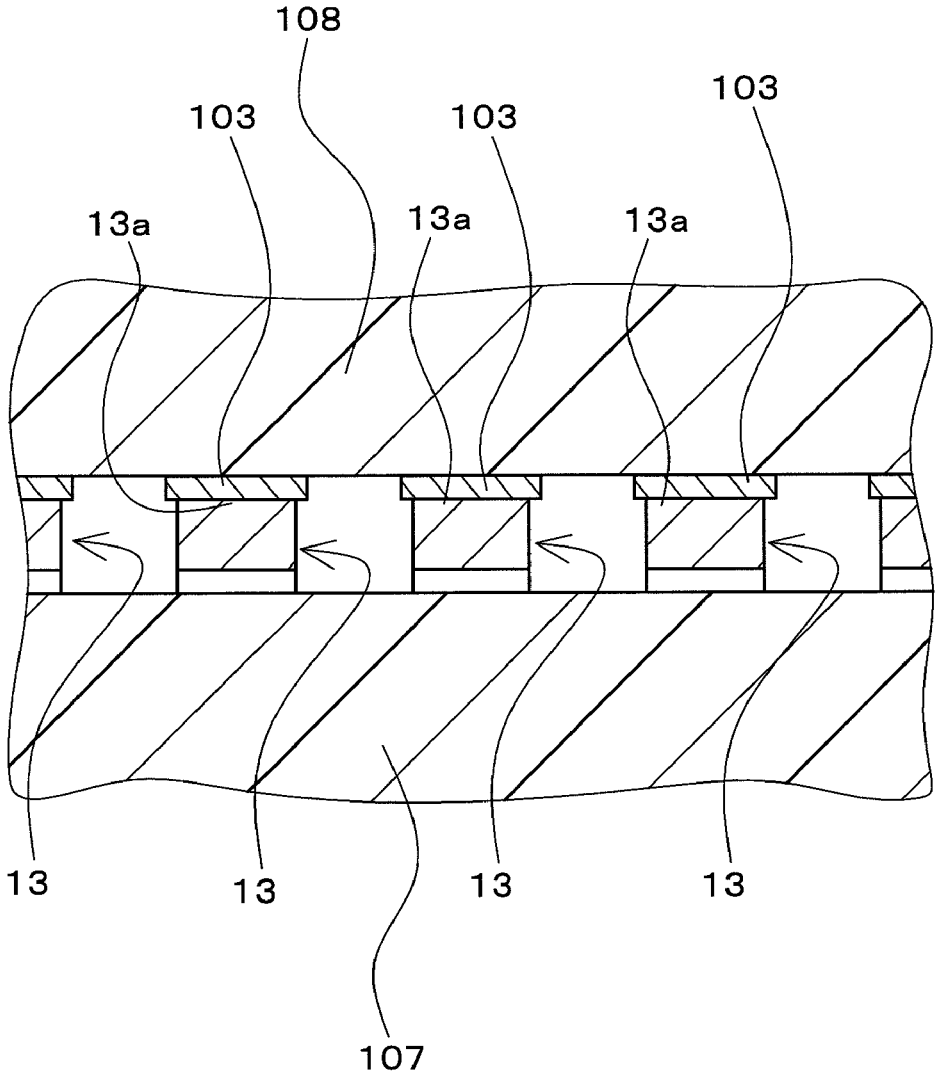
FIG. 17 is an enlarged cross-sectional view illustrating, in enlargement, a partial cross section of a terminal-side electrode, a conductor-side electrode, terminals, and conductors during resistance welding, taken at a position corresponding to the position taken in the direction of the arrows E-E in FIG. 15.

In the resistance welding step S104, a pair of electrode units are used that respectively include a terminal-side electrode 107 and a conductor-side electrode 108 and that are disposed facing each other with portions of contact between the plurality of terminals 13 and the plurality of conductors 103 interposed therebetween as shown in FIGS. 15 and 16. FIG. 17 is an enlarged cross-sectional view illustrating, in enlargement, a partial cross section of the terminal-side electrode 107, the conductor-side electrode 108, the terminals 13, and the conductors 103 during resistance welding using the above-described electrode units, taken at a position corresponding to the position taken in the direction of the arrows E-E in FIG. 15.

As shown in FIGS. 15 to 17, the terminal-side electrode 107 is provided as a plate-like electrode that is integrally formed in the shape of a rectangular solid so as to be capable of simultaneously coming into contact with all of the plurality of terminals 13 in portions surrounding the raised portions 13*a* on the side opposite to the protruding direction of the raised portions 13*a*. The terminal-side electrode 107 is inserted, from the body-side opening 26, into the connector 1 that is disposed such that the connector width direction is parallel to the width direction of the terminal-side electrode 107. In this embodiment, the terminal-side electrode 107 constitutes a first electrode that is one of the terminal-side electrode 107 and the conductor-side electrode 108 and that comes into contact with the terminal 13, which is one of the terminal 13 and the conductor 103 that is provided with the raised portion 13*a*.

Figure 18:
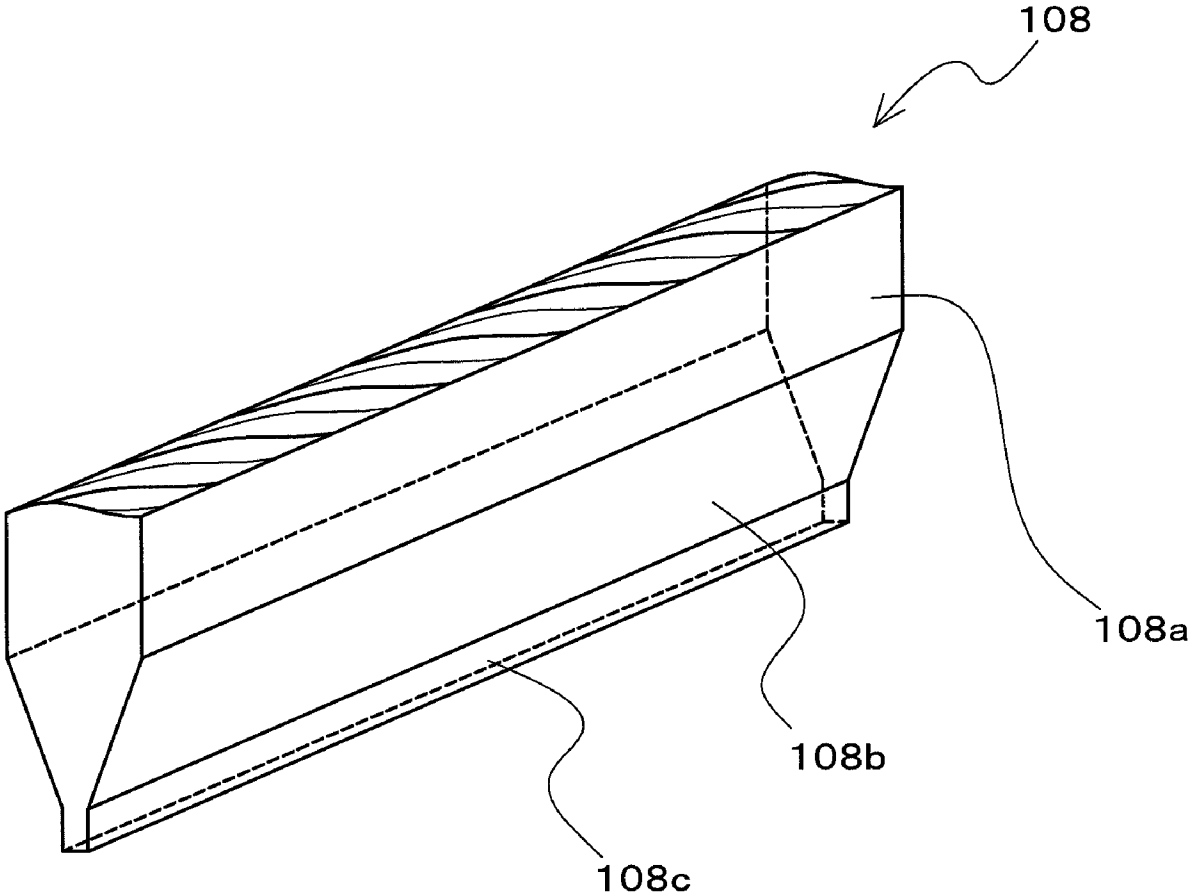
FIG. 18 is a perspective view illustrating the conductor-side electrode shown in FIG. 15 in a partially cut-out cross section.

FIG. 18 is a perspective view of the conductor-side electrode 108, which is shown in a partially cut-out cross section. As shown in FIGS. 15 to 18, the conductor-side electrode 108 is provided as an electrode that is integrally formed so as to be capable of simultaneously coming into contact with all of the plurality of conductors 103 in the conductor-exposed portion 105 on the opposite side (the back side) of the locations where the plurality of conductors 13 abut against the raised portions 13*a*. The conductor-side electrode 108 is inserted, from the cover-side opening 32, into the connector 1 that is disposed such that the connector width direction is parallel to the width direction of the conductor-side electrode 108. In this embodiment, the conductor-side electrode 108 constitutes a second electrode that is the other of the terminal-side electrode 107 and the conductor-side electrode 108 and that comes into contact with the conductor 103, which is the other of the terminal 13 and the conductor 103 that is not provided with the raised portion 13*a*.

The conductor-side electrode 108 includes a base portion 108*a* for connecting to a power system (not shown), a reduced cross section portion 108*b* disposed distally of the base portion 108*a*, and a distal portion 108*c* disposed distally of the reduced cross section portion 108*b*, and these portions are formed into one piece to form the conductor-side electrode 108. The base portion 108*a* is provided as a portion formed in the shape of a rectangular solid. The reduced cross section portion 108*b* is provided as a portion that is formed in a shape whose cross-sectional area decreases distally. Note that this embodiment illustrates the reduced cross section portion 108*b* that is formed to have a trapezoidal cross section perpendicular to the width direction of the conductor-side electrode 108. The distal portion 108*c* is provided as a portion that extends more distally in the shape of a rectangular solid with its cross-sectional area remaining the same as that of the reduced cross section portion 108*b* at the distal end where the cross-sectional area is decreased most, and the distal end of the distal portion 108*c* is formed into a flat surface. Since the conductor-side electrode 108 is formed in this way, the above-described electrode units are configured such that the contact area where the terminal-side electrode 107 is in contact with the terminals 13 is larger than the contact area where the conductor-side electrode 108 is in contact with the conductors 103.

As shown in FIG. 15, at the time of performing resistance welding using the above-described electrode units, the terminal-side electrode 107 moves from the position indicated by the double-dashed line to the position indicated by the solid line in the direction indicated by the arrow F in FIG. 15, and passes through the body-side opening 26. Also, the terminal-side electrode 107 is disposed so as to abut against and come into contact with the plurality of terminals 13 on the side opposite to the side where the raised portions 13*a* come into contact with the conductors 103. On the other hand, the conductor-side electrode 108 moves from the position indicated by the double-dashed line to the position indicated by the solid line in the direction indicated by the arrow G in FIG. 15, and passes through the cover-side opening 32. Also, the conductor-side electrode 108 is disposed so as to abut against and come into contact with the plurality of conductors 103 abutting against the plurality of terminals 13 via the raised portions 13*a*, on the side opposite to the side where the plurality of conductors 103 come into contact with the raised portions 13*a*.

Then, a current is passed to the terminal-side electrode 107 and the conductor-side electrode 108 in a state where the plurality of terminals 13 and the plurality of conductors 103 are sandwiched therebetween as described above. That is, in a state where the terminal-side electrode 107 is in contact with the plurality of terminals 13 and the conductor-side electrode 108 is in contact with the plurality of conductors 103, a current is conducted between the terminal-side electrode 107 and the conductor-side electrode 108 so as to generate Joule heat for resistance welding in the portion of contact between each of the terminals 13 and each of the conductors 103 via the raised portion 13*a*. At the same time with this current conduction, a pressurizing operation is performed in which a force is applied in the directions in which the terminal-side electrode 107 and the conductor-side electrode 108 press the plurality of terminals 13 and the plurality of conductors 103 from opposite sides. Consequently, the portion of contact, via the raised portion 13*a*, between each of the terminal 13 and each of the conductors 103 sandwiched between the terminal-side electrode 107 and the conductor-side electrode 108 is melted by heating, and is welded by further pressurization. Upon completion of welding, the current conduction and the pressurizing operation are finished, and each of the terminals 13 and each of the conductors 103 have been solidly bonded by resistance welding. Consequently, the manufacturing method of this embodiment ends.

With the flat cable connector 1 described above, the end of the flat cable 100 that includes the conductor-exposed portion 105 is disposed in the body housing 11 that supports the plurality of terminals 13. Next, the cover housing 12 is engaged with and attached to the body housing 11, and thereby the plurality of terminals 13 and the plurality of conductors 103 in the conductor-exposed portion 105 are held between the cover housing 12 and the body housing 11. Also, with the flat cable connector 1 of this embodiment, the plurality of terminals 13 and the plurality of conductors 103 are welded together by performing resistance welding with the terminals 13 and the conductors 103 abutting against each other via the raised portions 13*a* formed in the terminals 13. Accordingly, with the use of the flat cable connector 1 of this embodiment, it is possible to weld the terminals 13 and the conductors 103 together by resistance welding in a state where a current is passed concentratedly to the raised portion 13*a* that is formed such that a portion of the terminals 13 protrudes. This makes it possible to significantly suppress the current required to be conducted for resistance welding to a small amount compared to the conventional technology, thus reducing the power consumption required for resistance welding. Furthermore, since the terminals 13 and the conductors 103 can be welded together in a state where a current is passed concentratedly to the raised portion 13*a*, it is possible to suppress variation in the welded state, thus achieving stable welding quality.

Thus, according to this embodiment, it is possible to provide a flat cable connector 1 that enables welding to be performed with a small current with regard to resistance welding of the plurality of terminals 13 of the flat cable connector and the plurality of conductors 103 of the flat cable 100, thus reducing power consumption during welding, and that can also achieve stable welding quality.

With the flat cable connector 1, the raised portion 13*a* is formed by a pressing process or by a folding process for making a plurality of bends, and therefore it is possible to easily process the raised portion 13*a* that is provided such that a portion of the terminals 13 protrudes, even in the case where the size of the terminals 13 or the conductors 103 is small.

With the flat cable connector 1, the raised portion 13*a* is formed so as to protrude in the width direction by a pressing process or by a folding process for making a plurality of bends. Accordingly, even for a terminal 13 having a short length in the width direction, it is possible to easily process a raised portion 13*a* that is provided such that a portion of the terminal 13 protrudes. Further, by processing the raised portion 13*a* for the terminals 13*a*, which have higher rigidity than the conductors 103 of the flat cable 100, it is possible to easily ensure good shape stability in the processed raised portion 13*a*. Accordingly, it is possible to easily ensure a state of contact between of the terminals 13 and the conductors 103 via only the raised portion 13*a* during resistance welding.

With the flat cable connector 1, in the end of the flat cable 100, the tip insulation covering portion 106 is provided at the tip end of the conductor-exposed portion 105 at the time of forming the conductor-exposed portion 105. Accordingly, it is possible to prevent the plurality of conductors 103 from unraveling at the end of the flat cable 100 that is provided with the conductor-exposed portion 105. This facilitates the operation of connecting the flat cable connector 1 to the flat cable 100, thus improving the operational efficiency. Furthermore, with the flat cable connector 1, the cover housing 12 is provided with the conductor-facing portions 33 protruding in a block shape and facing the plurality of conductors 103. Also, the conductor-facing portions 33 are each disposed such that the tip abuts against the conductors 103. Alternatively, as described as a modification in relation to FIG. 13, the conductor-facing portions 33 are each disposed such that the spacing D1 between the tip and the conductors 103 is smaller than the spacing D2 between the surface of the conductors 103 and the surface of the tip insulation covering portion 106. Accordingly, even in the case where external force such as tension is exerted on the end of the flat cable 100 that is disposed between the body housing 11 and the cover housing 12, the conductor-facing portions 33 come into locking engagement with the tip insulation covering portion 106. This inhibits the end of the flat cable 100 from being detached from between the body housing 11 and the cover housing 12, making it possible to stably hold the end of the flat cable 100 between the body housing 11 and the cover housing 12.

With the flat cable connector 1, a plurality of conductor-facing portions 33 are provided protruding in correspondence with the conductors 103, and can come into locking engagement with the tip insulation covering portion 106 in positions respectively corresponding to the plurality of conductors 103 abutting against the plurality of terminals 13. Accordingly, it is possible to stably hold the end of the flat cable 100 between the body housing 11 and the cover housing 12 so as to inhibit misalignment between the terminals 13 and the conductors 103 that abut against each other.

With the flat cable connector 1, the body-side opening 26 and the cover-side opening 32 that cause the plurality of terminals 13 and the plurality of conductors 103 to be exposed to the outside across the connector width direction are formed in the body housing 11 and the cover housing 12, respectively, so as to face each other via the plurality of terminals 13 and the plurality of conductors 103. Also, the plurality of terminals 13 and the plurality of conductors 103 are welded together by performing resistance welding via the body-side opening 26 and the cover-side opening 32. Accordingly, with the use of the flat cable connector 1 of this embodiment, it is possible to easily perform resistance welding by inserting the electrodes, respectively, from the body-side opening 26 and the cover-side opening 32 that are widely open across the connector width direction, into the plurality of terminals 13 and the plurality of conductors 103 that are held between the body housing 11 and the cover housing 12, then causing the electrodes to abut against each other, and also conducting a current between the electrodes. It is also possible to significantly alleviate constraints on the electrodes that are to be inserted because the body-side opening 26 and the cover-side opening 32 are formed so as to be widely open across the connector width direction. Since constraints on the electrodes can be significantly alleviated in this way, it is possible to easily weld together the plurality of terminals 13 and the plurality of conductors 103 that are disposed abutting against each other via the raised portions 13*a* by resistance welding using electrodes that are appropriately selected from among various electrodes having various configurations in consideration of the operability and the efficiency. This facilitates the operation of connecting the flat cable connector 1 to the flat cable 100, which also makes it possible to reduce the processing time required from the completion of welding between all the terminals 13 and all the conductors 103 until the end of connection therebetween.

With the flat cable connector 1, the cover-side opening 32 from which an electrode is inserted at the time of resistance welding is formed so as to spread outwardly with its opening area being enlarged. Accordingly, it is possible to form an opening that can secure, in the vicinity of locations where the terminals 13 and the conductors 103 abut against each other and welded together via the raised portion 13*a*, a space required for disposing the distal portion 108*c* of the conductor-side electrode 108 for passing a current concentratedly to the welded locations, while efficiently securing, in locations located a distance away from the welded locations, a wide space for alleviating constraints on the shape of the base portion 108*a* on the basal end and the reduced cross section portion 108*b* of the conductor-side electrode 108.

With the flat cable connector 1, the conductor-facing portions 33 are provided protruding on opposite sides in the conductor extension direction relative to the cover-side opening 32 so as to face the conductors 103 in the conductor-exposed portion 105. Accordingly, the conductor-facing portions 33 can come into locking engagement with the tip insulation covering portion 106, and can also come into locking engagement with an edge of the covering portion 104 located opposite to the tip insulation covering portion 106 via the conductor-exposed portion 105. This makes it possible to stably hold the end of the flat cable 100 between the body housing 11 and the cover housing 12 so as to inhibit misalignment between the terminals 13 and the conductors 103 that abut against each another, on opposite sides in the conductor extension direction relative to the welded locations between the terminals 13 and the conductors 103.

With the flat cable connector 1, the body housing 11 is provided with the plurality of inter-conductor projections 25 that are formed protruding so as to be inserted between the plurality of conductors 103. Accordingly, when the conductor-exposed portion 105 at the end of the flat cable 100 is disposed between the body housing 11 and the cover housing 12, the conductors 103 in the conductor-exposed portion 105 can be guided to predetermined positions by the plurality of inter-conductor projections 25, making it possible to accurately position the conductors 103 in locations where they abut against the terminals 13. The inter-conductor projections 25 may be provided in the cover housing 12. However, with the flat cable connector 1, provision of the inter-conductor projections 25 in the body housing 11 allows the conductors 103 to be guided by the plurality of inter-conductor projections 25 and accurately positioned in locations where they abut against the terminals 13 when the end of the flat cable 100 is disposed in the body housing 11. This makes it possible to accurately position the conductors 103 and the terminals 13 in a state before the cover housing 12 is attached to the body housing 11, thus easily performing positioning between the conductors 103 and the terminals 13.

With the flat cable connector 1, the plurality of terminals 13 are integrally formed with the body housing 11 in a state where the terminals 13 are bent in such a manner that the portion facing the tip insulation covering portion 106 is spaced away from the tip insulation covering portion 106. Accordingly, even if the tip insulation covering portion 106 is provided at the end of the flat cable 100, it is possible to prevent the plurality of terminals 13 and the tip insulation covering portion 106 from interfering with each other at the time of connection. This makes it possible to prevent displacement of positioning between the plurality of terminals 13 and the plurality of conductors 103 in the conductor-exposed portion 105 due to interference between the plurality of terminals 13 and the tip insulation covering portion 106.

Furthermore, with the harness 10 and the harness manufacturing method according to this embodiment, it is possible to realize a harness 10 that can achieve the same effect as that achieved with the flat cable connector 1 described above. Therefore, it is possible, with this embodiment, to provide a harness 10 and a manufacturing method thereof that enable welding to be performed with a small current with regard to resistance welding of the plurality of terminals 13 of the flat cable connector 1 and the plurality of conductors 103 of the flat cable 100, thus reducing power consumption during welding, and that can also achieve stable welding quality.

With the harness manufacturing method according to this embodiment, the terminal-side electrode 107 serving as the first electrode comes into contact with the terminal 13, which is one of the terminal 13 and the conductor 103 that is provided with the raised portion 13*a*, and the conductor-side electrode 108 serving as the second electrode comes into contact with the conductor 103, which is the other of the terminal 13 and the conductor 103 that is not provided with the raised portion 13*a*. Since the conductor-side electrode 108 is provided with the reduced cross section portion 108*b* that is a portion whose cross-sectional area decreases distally, it is possible to pass a current concentratedly to a narrow region. This makes it possible to efficiently bring the distal end of the conductor-side electrode 108 into contact with the conductor 103 in a narrow region located on the opposite side of the location where the conductor 103 abuts against the raised portion 13*a*. Also, it is possible to efficiently pass a current concentratedly to the portion where the conductor 103 abuts against the raised portion 13*a*. Furthermore, the contact area of the terminal-side electrode 107 in contact with the terminal 13 is set larger than the contact area of the conductor-side electrode 108 in contact with the conductor 103. Accordingly, during resistance welding, the portion in the terminal 13 that surround the raised portion 13*a* on the side opposite to the protruding direction of the raised portion 13*a* is stably supported by the terminal-side electrode 107 having a larger contact area.

With the harness manufacturing method according to this embodiment, the terminal-side electrode 107 that is formed integrally so as to be capable of simultaneously coming into contact with the plurality of terminals 13 is inserted from the body-side opening 26, and the conductor-side electrode 108 that is integrally formed so as to be capable of simultaneously coming into contact with the plurality of conductors 103 in the conductor-exposed portion 105 is inserted from the cover-side opening 32. Also, resistance welding can be performed by simultaneously pressurizing the plurality of terminals 13 and the plurality of conductors 103 between the terminal-side electrode 107 and the conductor-side electrode 108, and also simultaneously passing a current to the plurality of terminals 13 and the plurality of conductors 103. This makes it possible to simultaneously weld the plurality of terminals 13 and the plurality of conductors 103 together with the same timing, thus facilitating the welding operation of the plurality of terminals 13 and the plurality of conductors 103 and increasing the efficiency of the welding operation.

Although am embodiment of the present invention has been described thus far, all modifications, applications and equivalents thereof that fall within the claims, for which modifications and applications would become apparent by reading and understanding the present specification, are intended to be embraced therein. For example, the following modifications are possible.

(1) Although this embodiment has been described, taking, as an example, a case where the raised portion is provided in the terminals, this need not be the case. That is, the raised portion may be provided in the conductors, or the raised portion may be provided in both the terminals and the conductors. Further, the raised portion may not be formed by a pressing process or a folding process, and may be formed in a shape that is different from those described in the above-described embodiment. For example, the raised portion may be formed in the shape of a dimple or a projection.

(2) Although this embodiment has been described, taking, as an example, a flat cable connector in which the cover housing is formed separately from the body housing, this need not be the case. For example, the cover housing may be formed so as to be coupled to the body housing via an integrally formed hinge portion.

(3) Although this embodiment has been described, taking, as an example, a case where the body-side opening and the cover-side opening that are formed so as to extend across the connector width direction are provided, the openings may not necessarily have such a shape, and various modifications are possible. For example, a plurality of through holes corresponding to the terminals may be formed as the openings in the body housing. Likewise, a plurality of through holes corresponding to the conductors may be formed as the openings in the cover housing. Alternatively, an opening having a shape other than the shape of a through hole may be formed. For example, comb teeth-like portions may be formed in the cover housing, and the openings on the cover housing side are provided as slits between the comb teeth-like portions.

Although this embodiment has been described, taking as an example, the flat cable connector in which only the cover-side opening is formed so as to spread outwardly, this need not be the case. For example, both the cover-side opening and the body-side opening may be formed so as to spread outwardly.

(4) Although this embodiment has been described, taking, as an example, the flat cable connector in which the inter-conductor projections are provided in the body housing, this need not be the case; the inter-conductor projections may be provided in the cover housing. The number and the shape of the inter-conductor projections may be changed as appropriate. The number and the shape of the conductor-facing portions may also be changed as appropriate.

(5) Although this embodiment has been described, taking, as an example, the harness provided with one flat cable connector and one flat cable, this need not be the case. For example, a flat cable connector may be connected to each of the branched portions of one flat cable that is branched in the middle. Alternatively, a plurality of flat cables may be connected to one flat cable connector.

(6) The shape of the terminal-side electrode and the conductor-side electrode that are used in the resistance welding step are not limited to the shapes described in the manufacturing method according to this embodiment, and various modifications are possible. For example, it is possible to adopt a configuration in which a terminal-side electrode coming into contact with only one terminal and a conductor-side electrode coming into contact with only one conductor are used, and resistance welding is performed for the terminals and the conductors in order. Alternatively, an electrode 109 according to a modification as shown in the perspective view in FIG. 19(*a*) may be used as the second electrode coming into contact with the other of the terminal and the conductor that is not provided with the raised portion.

Figure 19A:
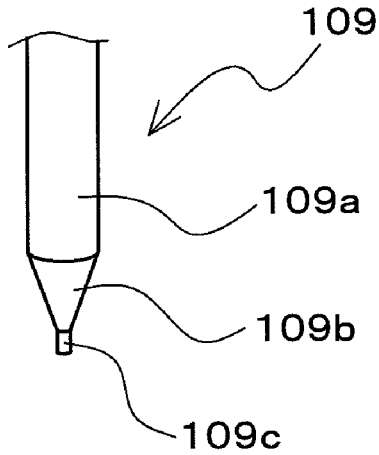
FIG. 19(*a*) is a perspective view illustrating an electrode according to a modification.
Figure 19B:
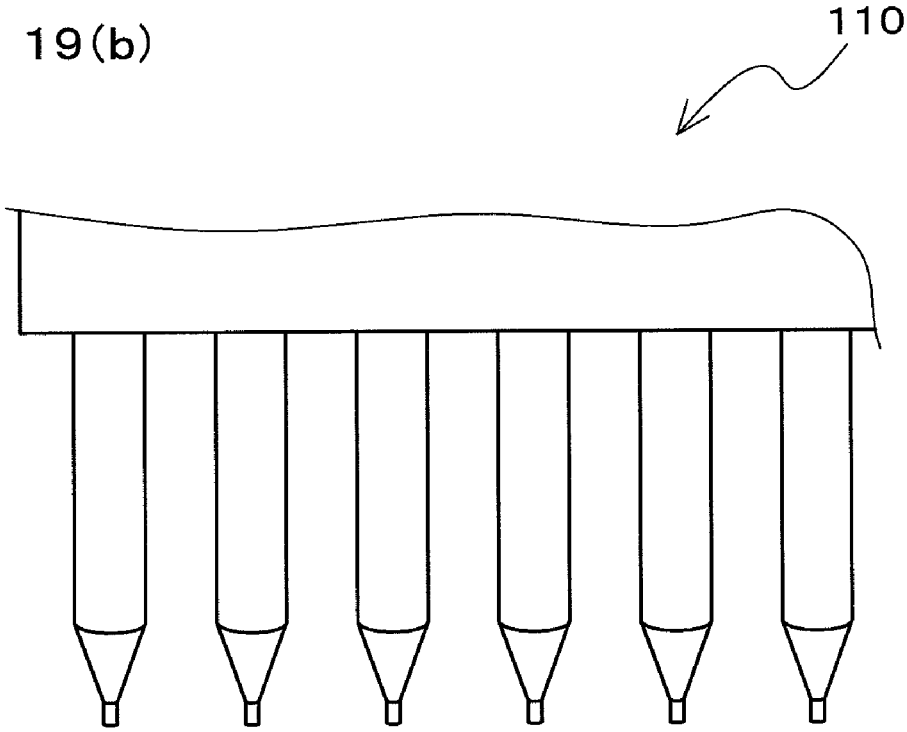

As shown in FIG. 19(*a*), the electrode 109 is provided with a base portion 109*a*, a reduced cross section portion 109*b*, and a distal portion 109*c*. The base portion 109*a* is connected to a power system (not shown), and is provided as a portion formed in the shape of a column. The reduced cross section portion 109*b* is formed integrally with the base portion 109*a* to be disposed distally of the base portion 109*a*, and is provided as a portion that is formed in a shape whose cross-sectional area decreases distally such that its outer circumference forms a part of a conic section. The distal portion 109*c* is formed integrally with the reduced cross section portion 109*b* to be disposed distally of the reduced cross section portion 109*b*. Also, the distal portion 109*c* is provided as a portion that extends more distally in the shape of a column with its cross-sectional area remaining the same as that of the reduced cross section portion 109*b* at the distal end where the cross-sectional area is decreased most, and the distal end of the distal portion 109*c* is formed as a flat surface.

According to the modification shown in FIG. 19(*a*), the electrode 109 serving as the second electrode is provided with the reduced cross section portion 109*b* whose cross-sectional area decreases in the shape of a cone, and a flat surface is formed at the distal end of the distal portion 109*c*. Accordingly, it is possible to realize an electrode shape that enables a current to be passed concentratedly to the narrow distal region with a good space efficiency, and that can easily ensure, in the distal portion 109*c*, the necessary contact area for the other of the terminal and the conductor that is not provided with the raised portion, in the region on the opposite side of the location where the conductor abuts against the raised portion.

FIG. 19(*b*) is a perspective view illustrating an electrode 110 according to another modification for the electrode shape of the second electrode. The electrode 110 shown in FIG. 19(*b*) is integrally formed so as to be capable of simultaneously coming into contact with the plurality of terminal or the plurality of conductors that are not provided with the raised portions. For example, in the case where the terminals are provided with the raised portion and the conductors are not provided with the raised portions, the electrode 110 is integrally formed so as to be capable of simultaneously coming into contact with the plurality of conductors. In this case, in the electrode 110, portions that are formed in the same manner as the distal end of the electrode 109 shown in FIG. 19(*a*) are arranged parallel to each other in the shape of comb-teeth as the portions simultaneously coming into contact with the conductors. It is possible to adopt a configuration in which resistance welding is performed using such an electrode 110.

Figure 20:
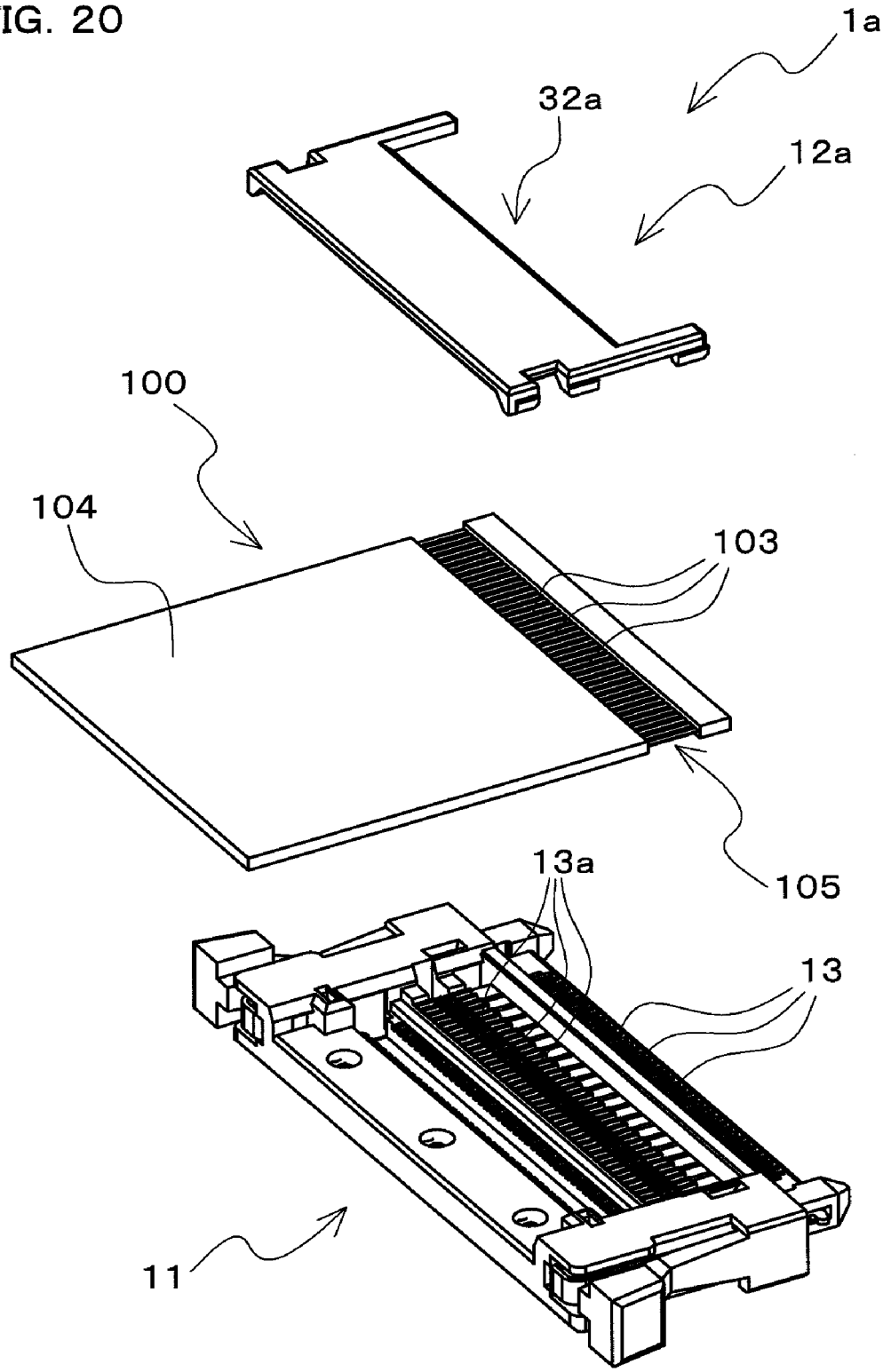
FIG. 20 is a perspective view illustrating a flat cable connector according to a modification and a part of a flat cable.
Figure 21:
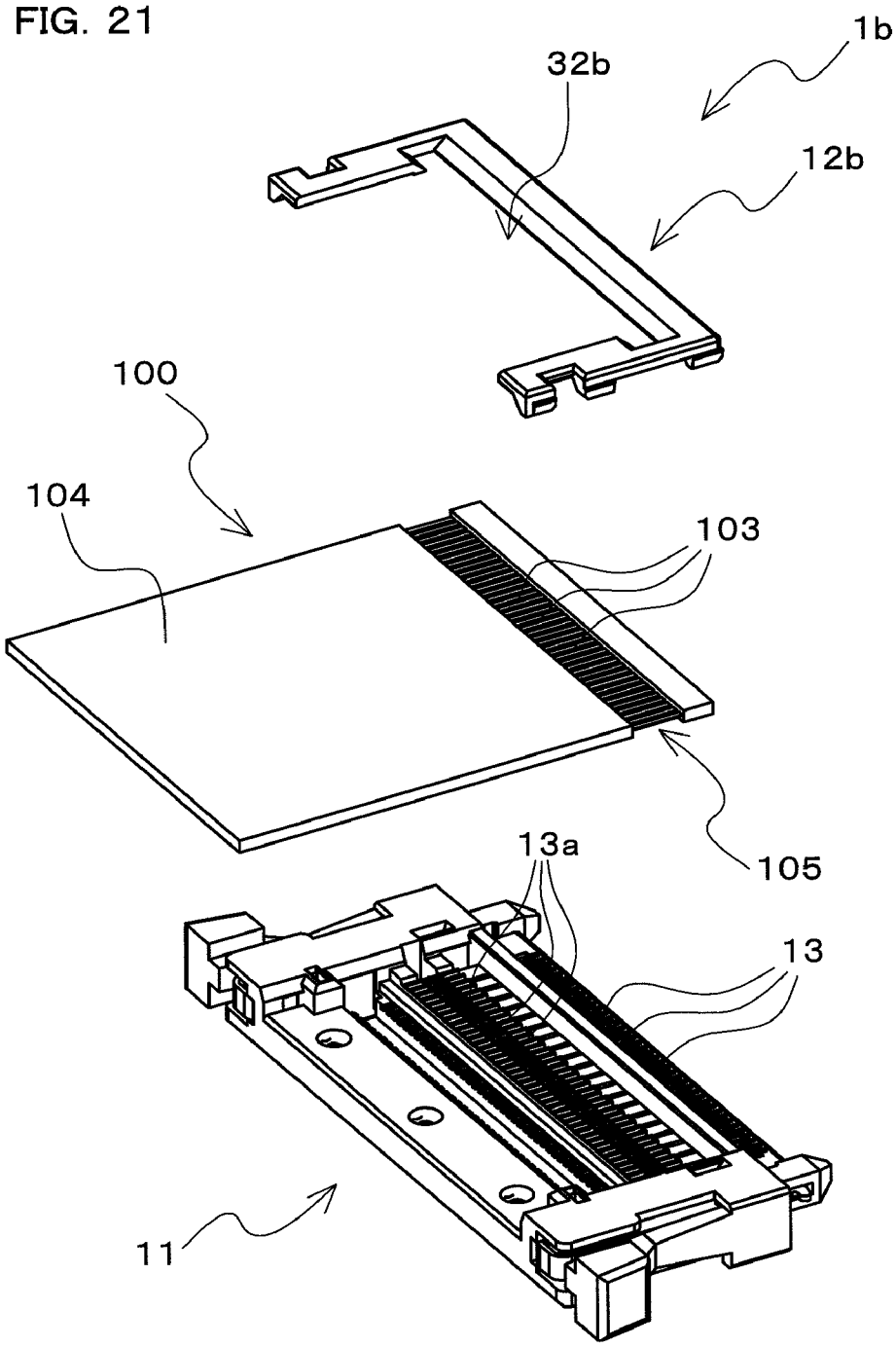
FIG. 21 is a perspective view illustrating a flat cable connector according to another modification and a part of a flat cable.

(7) The above embodiment has been described, taking, as an example, a configuration in which the body-side opening and the cover-side opening are formed as holes each having a rectangular cross section that are formed so as to respectively pass through the body housing and the cover housing in the thickness direction, this need not be the case. That is, the body-side opening and the cover-side opening may be formed so as to extend in the connector width direction in the body housing and the cover housing, respectively, and may be formed so as to cause the plurality of conductors in the conductor-exposed portion and the plurality of terminals to be exposed to the outside across the connector width direction. For example, as shown in modifications as shown in FIGS. 20 and 21, it is possible to implement a flat cable connector that is provided with a body-side opening having a configuration other than a hole. Although FIGS. 20 and 21 show only modifications of the body-side opening, it is possible to implement a flat cable connector that is provided with a cover-side opening having a configuration other than a hole.

A flat cable connector 1*a* (hereinafter, simply referred to as a "connector 1*a*") according to the modification shown in FIG. 20 is formed in the same manner as the connector 1, but is different from the connector 1 in that a cover-side opening 32*a* provided in a cover housing 12*a* is formed in a configuration other than a hole. In FIG. 20, the same constituent elements as those of the connector 1 are denoted by the same reference numerals in the drawing, and the description thereof has been omitted.

The cover-side opening 32*a* of the cover housing 12*a* of the connector 1*a* shown in FIG. 20 is formed as a region that is open so as to be recessed from one end of the cover housing 12*a* in the conductor extension direction (in the modification shown in FIG. 20, the end of the cover housing 12*a* that faces the tip of the end of the flat cable 100) in the conductor extension direction. Also, the cover-side opening 32*a* formed as an opening region that is recessed in the conductor extension direction in the cover housing 12*a* is formed so as to extend in the connector width direction, and is configured to cause the plurality of conductors 103 in the conductor-exposed portion 105 that are disposed abutting against the plurality of terminals 13 to be exposed to the outside across the connector width direction. With such a connector 1*a*, it is also possible to achieve the same effect as that achieved with the connector 1.

A flat cable connector 1*b* (hereinafter, simply referred to as a "connector 1*b*") according to the modification shown in FIG. 21 is configured in the same manner as the connector 1, but is different from the connector 1 in that a cover-side opening 32*b* provided in a cover housing 12*b* is formed in a configuration other than a hole. In FIG. 21, the same constituent elements as those of the connector 1 are denoted by the same reference numerals in the drawing, and the description thereof has been omitted.

The cover-side opening 32*b* of the cover housing 12*b* of the connector 1*b* shown in FIG. 21 is formed as a region that is open so as to be recessed from the other end of the cover housing 12*b* in the conductor extension direction (in the modification shown in FIG. 21, the end opposite to the end of the cover housing 12*b* that faces the tip of the end of the flat cable 100) in the conductor extension direction. Also, the cover-side opening 32*b* formed as an opening region that is recessed in the conductor extension direction in the cover housing 12*b* is formed so as to extend in the connector width direction, and is configured to cause the plurality of conductors 103 in the conductor-exposed portion 105 that are disposed abutting against the plurality of terminals 13 to be exposed to the outside across the connector width direction. With such a connector 1*b*, it is also possible to achieve the same effect as that achieved with the connector 1.

(8) Although the flat cable connector, the harness, and the harness manufacturing method according to the above embodiment have been described, taking, as an example, a configuration in which the tip insulation covering portion is provide at the end of the flat cable, this need not be the case. That is, it is possible to implement a flat cable connector for connecting to a flat cable having a configuration in which a tip insulation covering portion is not provided at its end, a harness including a flat cable having a configuration in which a tip insulation covering portion is not provided at its end, and a method for manufacturing the harness. Furthermore, it is possible to implement a harness in which, when or after a flat cable connector is connected to a flat cable that is provided with a tip insulation covering portion at its end, the tip insulation covering portion of the flat cable is removed, and a method for manufacturing the harness.

Figure 22:
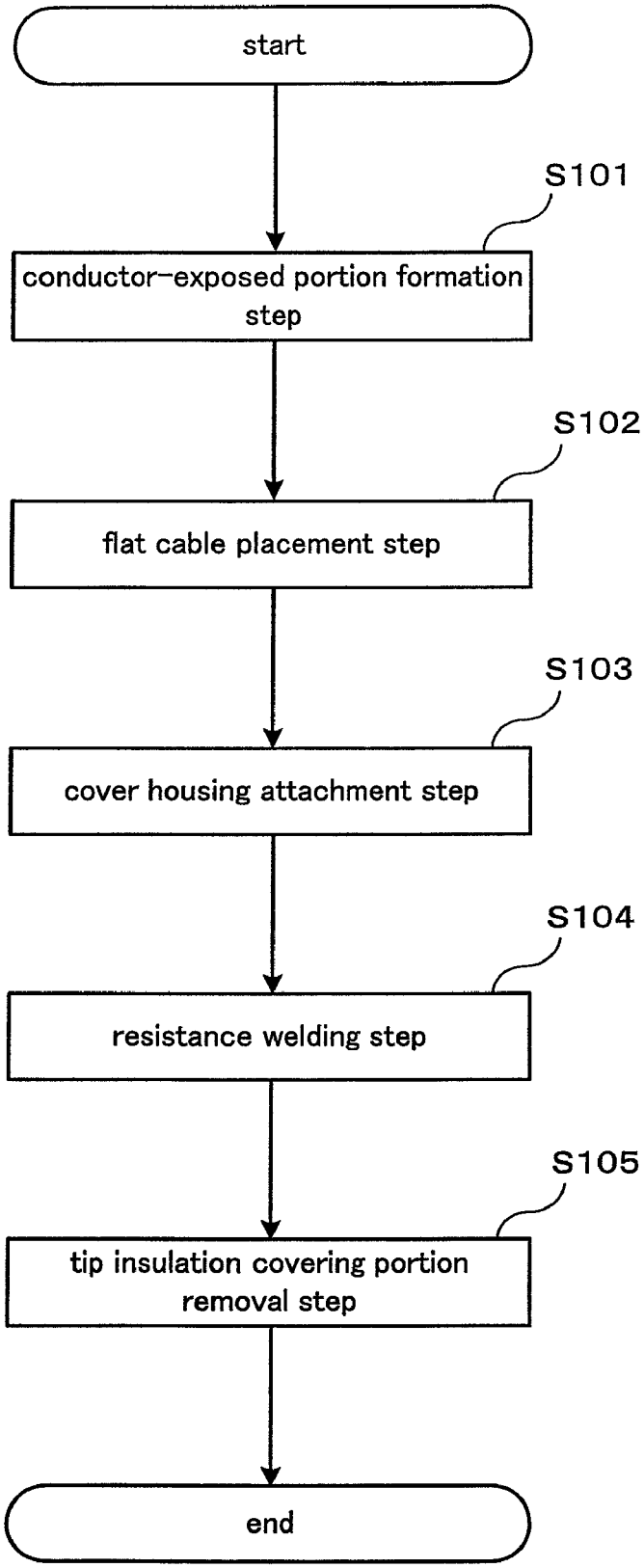
FIG. 22 is a flowchart illustrating a harness manufacturing method according to a modification.

FIG. 22 is a flowchart illustrating a harness manufacturing method according to a modification. The flowchart in FIG. 22 illustrates a method for manufacturing a harness in which, when or after a flat cable connector is connected to a flat cable that is provide with a tip insulation covering portion at its end, the tip insulation covering portion of the flat cable is removed. As with the harness manufacturing method whose flowchart is shown in FIG. 14, the harness manufacturing method according to the modification shown in FIG. 22 includes a conductor-exposed portion formation step S101, a flat cable placement step S102, a cover housing attachment step S103, and a resistance welding step S104. However, the harness manufacturing method according to the modification shown in FIG. 22 is different from the harness manufacturing method shown FIG. 14 in that it further includes a tip insulation covering portion removal step S105 as a subsequent step of the resistance welding step S104.

Figure 23:
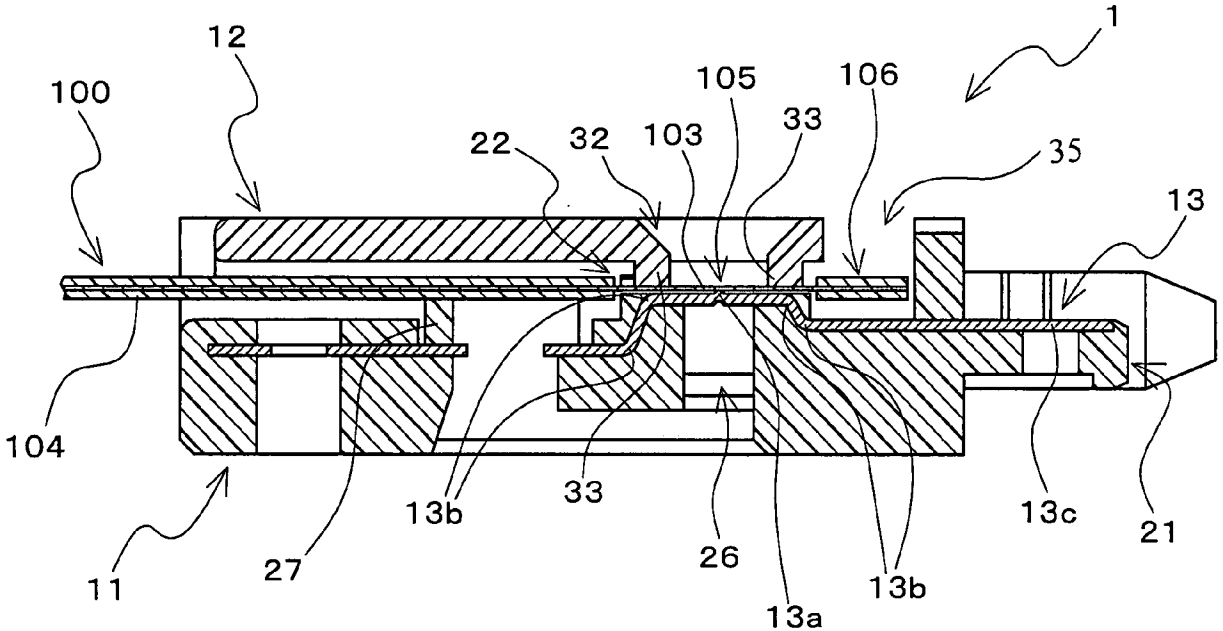
FIG. 23 is a cross-sectional view illustrating a connector and an end of a flat cable in a state where a welding step in the harness manufacturing method shown in FIG. 22 is finished.
Figure 24:
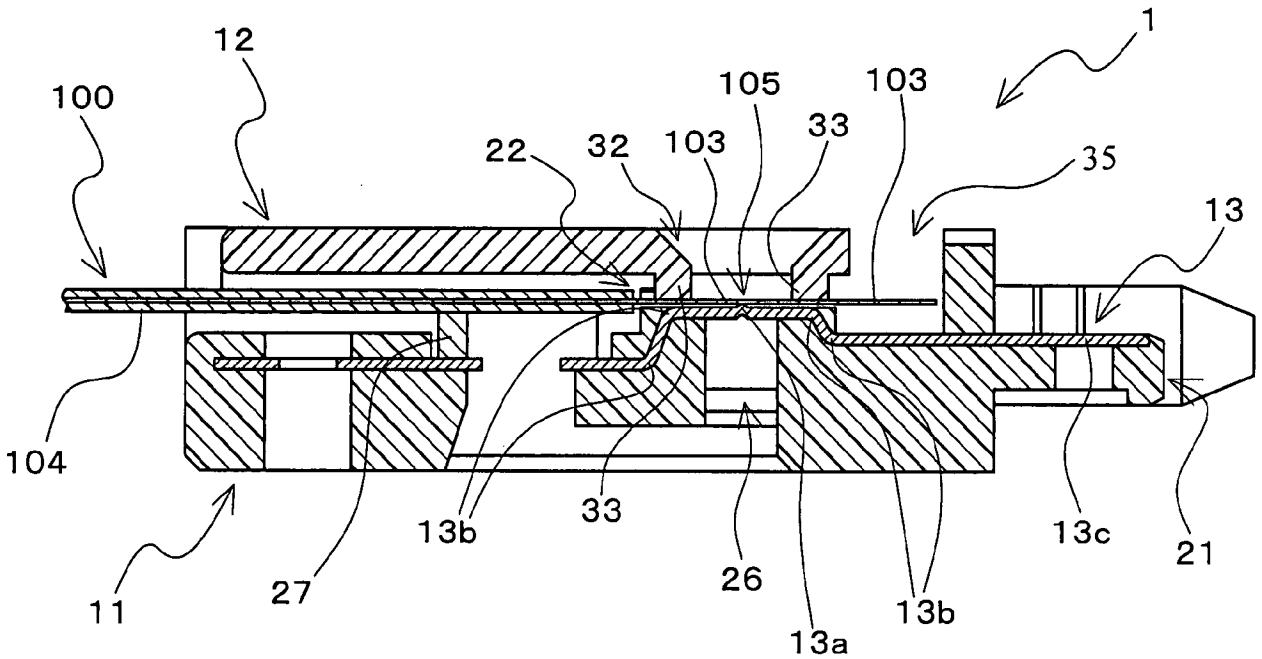
FIG. 24 is a cross-sectional view illustrating a connector and an end of a flat cable in a state where a tip insulation covering portion removal step in the harness manufacturing method shown in FIG. 22 is finished.

FIG. 23 is a cross-sectional view illustrating the connector 1 and an end of the flat cable 100 in a state where the resistance welding step S104 is finished, showing a cross-sectional view taken at the sectional position corresponding to FIG. 5 in the above-described embodiment. The cover housing 12 used in the harness manufacturing method according to the modification shown in FIG. 22 is formed, for example, such that its portion disposed at a position facing the tip insulation covering portion 106 causes the tip insulation covering portion 106 to be exposed to the outside, as shown in FIG. 23. That is, an open region 35 for causing the tip insulation covering portion 106 at the end of the flat cable 100 to be exposed to the outside is formed in the connector 1. In FIG. 23 and FIG. 24, which will be described later, the same constituent elements as those of the connector 1 are denoted by the same reference numerals in the drawings, and the description thereof has been omitted.

When the connector 1 and the flat cable 100 are brought into the state shown in FIG. 23 after completion of the resistance welding step S104, the tip insulation covering portion removal step S105 is then carried out. FIG. 24 is a cross-sectional view illustrating the connector 1 and an end of the flat cable 100 in a state where the tip insulation covering portion removal step S105 is finished, showing a cross-sectional view taken at the sectional position corresponding to FIG. 23. In the tip insulation covering portion removal step S105, as shown in FIG. 24, the covering portion 104 in the tip insulation covering portion 106 is completely removed by being uncovered so as to be pulled out in the direction of extension of the plurality of conductors 103, thus being removed from the open region 35 to the outside. With the harness manufacturing method shown in FIG. 22 that includes the tip insulation covering portion removal step S105, it is also possible to achieve the same effect as that achieved with the harness manufacturing method shown in FIG. 14.

Figure 25:
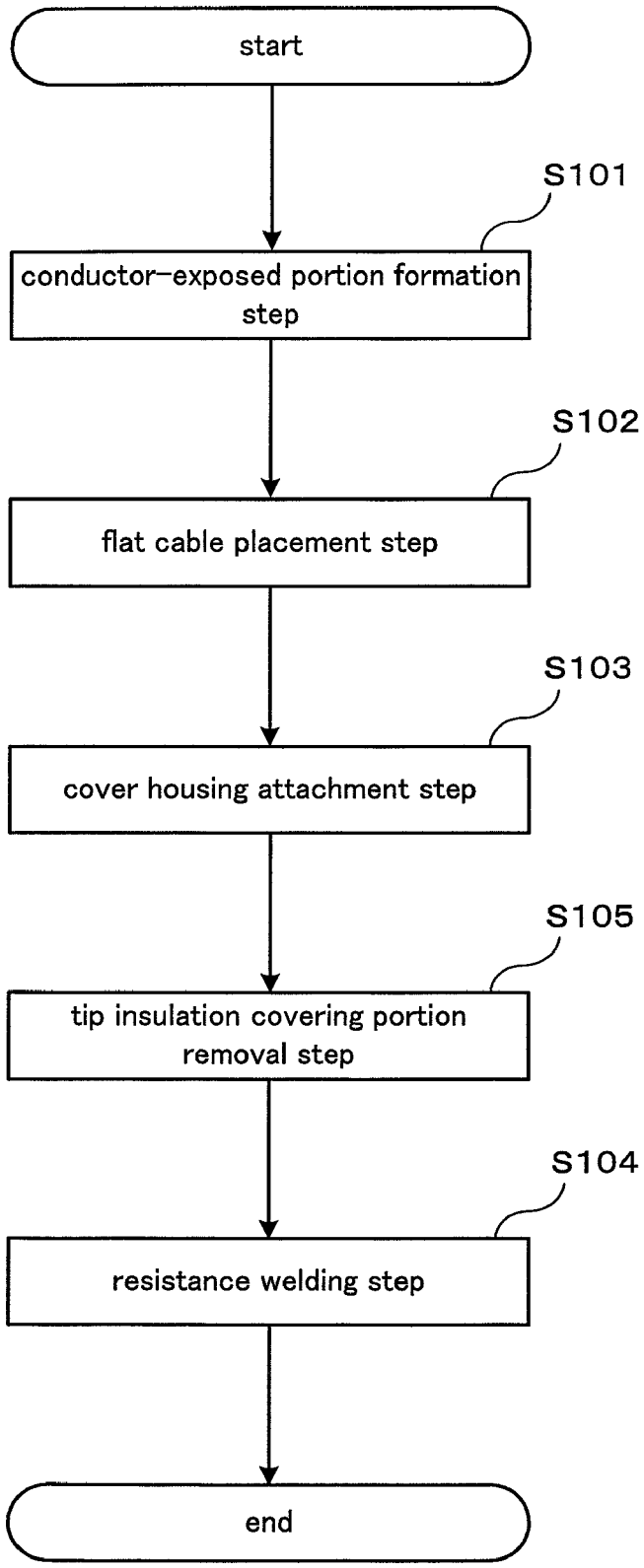
FIG. 25 is a flowchart illustrating a harness manufacturing method according to another modification.

Although the harness manufacturing method according to the modification shown in FIG. 22 has been described, taking as an example, a configuration in which the tip insulation covering portion removal step S105 is carried out as a subsequent step of the resistance welding step S104, this need not be the case. FIG. 25 is a flowchart illustrating a harness manufacturing method according to another modification, showing a harness manufacturing method in which, when the connector 1 is connected to the flat cable 100 that is provided with the tip insulation covering portion 106 at its end, the tip insulation covering portion 106 is removed as in the case of FIG. 22. In the following description, the elements configured in the same manner as in FIGS. 23 and 24 are denoted by the same reference numerals.

The harness manufacturing method shown in FIG. 25 is constructed such that the tip insulation covering portion removal step S105 is carried out as a preceding step of the resistance welding step S104, and is performed between the cover housing attachment step S103 and the resistance welding step S104. When the cover housing attachment step S103 is finished, the plurality of conductors 103 and the plurality of terminals 13 have been brought into a state where they are held between the body housing 11 and the cover housing 12 by being sandwiched and pressed such that they abut against each other. In this state, the tip insulation covering portion removal step S105 is carried out, and the covering portion 104 in the tip insulation covering portion 106 is completely removed by being uncovered so as to be pulled out in the direction of extension of the plurality of conductors 103, thus being removed from the open region 35 to the outside. After the tip insulation covering portion removal step S105 is finished, the resistance welding step S104 is carried out. With the harness manufacturing method shown in FIG. 25, it is also possible to achieve the same effect as that achieved with the harness manufacturing method shown in FIG. 14.

Although the harness manufacturing methods according to the modifications shown in FIGS. 22 and 25 has been described, taking as an example, a configuration in which the covering portion 104 in the tip insulation covering portion 106 is removed by being uncovered so as to be pulled out in the direction of extension of the plurality of conductors 103 in the tip insulation covering portion removal step S105, this need not be the case. For example, it is possible to adopt a configuration in which the covering portion 104 in the tip insulation covering portion 106 and the plurality of conductors 103 are removed together by cutting the plurality of conductors 103 in the tip insulation covering portion removal step S105.

The present invention can be widely applied as a flat cable connector for connecting to a flat cable that is formed by insulating a plurality of conductors arranged parallel to each other, a harness including the flat cable connector, and a method for manufacturing the harness.

What is claimed is:

1. A flat cable connector for connecting to a flat cable that is formed by insulating a plurality of conductors arranged parallel to each other, the flat cable connector comprising:

a plurality of terminals;

a body housing that supports the plurality of terminals with the plurality of terminals disposed parallel to each other, and in which can be disposed an end of the flat cable that includes a conductor-exposed portion where the plurality of conductors are exposed by an insulation covering portion having been partly removed; and a cover housing that is engaged with and attached to the body housing and that holds the plurality of terminals and the plurality of conductors so as to be sandwiched between the body housing and the cover housing, with the plurality of terminals and the plurality of conductors in the conductor-exposed portion respectively abutting against each other, wherein the terminals and/or the conductors in the conductor-exposed portion are provided with a raised portion that is formed such that a portion of the terminals and/or the conductors in the conductor-exposed portion protrudes, and the plurality of terminals and the plurality of conductors in the conductor-exposed portion are respectively welded together by performing resistance welding with the terminals and the conductors abutting against each other via the raised portion, the raised portion being formed in the terminals so as to protrude in the conductor-exposed portion across a width direction that is perpendicular to the longitudinal direction of the terminals by performing a pressing process or by performing a folding process for making a plurality of bends.

2. A flat cable connector for connecting to a flat cable that is formed by insulating a plurality of conductors arranged parallel to each other, the flat cable connector comprising:

a plurality of terminals;

a body housing that supports the plurality of terminals with the plurality of terminals disposed parallel to each other, and in which can be disposed an end of the flat cable that includes a conductor-exposed portion where the plurality of conductors are exposed by an insulation covering portion having been partly removed; and a cover housing that is engaged with and attached to the body housing and that holds the plurality of terminals and the plurality of conductors so as to be sandwiched between the body housing and the cover housing, with the plurality of terminals and the plurality of conductors in the conductor-exposed portion respectively abutting against each other, wherein the terminals and/or the conductors in the conductor-exposed portion are provided with a raised portion that is formed such that a portion of the terminals and/or the conductors in the conductor-exposed portion protrudes, and the plurality of terminals and the plurality of conductors in the conductor-exposed portion are respectively welded together by performing resistance welding with the terminals and the conductors abutting against each other via the raised portion, the body housing is provided with a body-side opening that is formed so as to extend in a connector width direction that is a width direction perpendicular to a conductor extension direction that is a direction parallel to the direction of extension of the plurality of conductors being held between the body housing and the cover housing, and that causes the plurality of terminals to be exposed to the outside across the connector width direction, the cover housing is provided with a cover-side opening that is formed so as to extend across the connector width direction, and that causes the plurality of conductors in the conductor-exposed portion to be exposed to the outside across the connector width direction, the body-side opening and the cover-side opening are provided so as to be open toward each other via the plurality of conductors and the plurality of terminals being held, and the plurality of terminals and the plurality of conductors in the conductor-exposed portion are respectively welded together by performing resistance welding via the body-side opening and the cover-side opening.

3. The flat cable connector according to claim 2, wherein at least one of the body-side opening and the cover-side opening is formed so as to spread outwardly with an opening area thereof being enlarged.

4. A flat cable connector for connecting to a flat cable that is formed by insulating a plurality of conductors arranged parallel to each other, the flat cable connector comprising:

a plurality of terminals;

a body housing that supports the plurality of terminals with the plurality of terminals disposed parallel to each other, and in which can be disposed an end of the flat cable that includes a conductor-exposed portion where the plurality of conductors are exposed by an insulation covering portion having been partly removed; and a cover housing that is engaged with and attached to the body housing and that holds the plurality of terminals and the plurality of conductors so as to be sandwiched between the body housing and the cover housing, with the plurality of terminals and the plurality of conductors in the conductor-exposed portion respectively abutting against each other, wherein the terminals and/or the conductors in the conductor-exposed portion are provided with a raised portion that is formed such that a portion of the terminals and/or the conductors in the conductor-exposed portion protrudes, the plurality of terminals and the plurality of conductors in the conductor-exposed portion are respectively welded together by performing resistance welding with the terminals and the conductors abutting against each other via the raised portion, in the end of the flat cable, the conductor-exposed portion is formed by uncovering an insulation covering portion so as to be pulled out in the direction of extension of the plurality of conductors, and a tip insulation covering portion is provided by a part of the covering portion that has been displaced so as to be pulled out being left at a tip of the end of the flat cable, the cover housing is provided with a conductor-facing portion that is formed so as to protrude in a block shape toward the plurality of conductors in the conductor-exposed portion and that is disposed such that a tip thereof faces the conductors, the conductor-facing portion is disposed such that the tip thereof abuts against the conductors, or disposed such that the spacing between the tip thereof and the conductors is smaller than the spacing between the surface of the conductors and the surface of the tip insulation covering portion, the body housing is provided with a body-side opening that is formed so as to extend in a connector width direction that is a width direction perpendicular to a conductor extension direction that is a direction parallel to the direction of extension of the plurality of conductors being held between the body housing and the cover housing, and that causes the plurality of terminals to be exposed to the outside across the connector width direction, the cover housing is provided with a cover-side opening that is formed so as to extend across the connector width direction, and that causes the plurality of conductors in the conductor-exposed portion to the outside across the connector width direction, the body-side opening and the cover-side opening are provided so as to be open toward each other via the plurality of conductors and the plurality of terminals being held, the plurality of terminals and the plurality of conductors in the conductor-exposed portion are respectively welded together by performing resistance welding via the body-side opening and the cover-side opening, and the conductor-facing portion is provided protruding so as to face the plurality of conductors on opposite sides in the conductor extension direction relative to the cover-side opening.

* * * * *